US010766047B2

(12) United States Patent
Wong et al.

(10) Patent No.: US 10,766,047 B2
(45) Date of Patent: Sep. 8, 2020

(54) DISPENSING CONTAINER AND ACTUATOR THEREFOR

(71) Applicant: MEDISCA PHARMACEUTIQUE INC., St-Laurent (CA)

(72) Inventors: Sarah Nyat Peng Wong, Saint-Laurent (CA); Patrick-Martin Bader, St-Laurent (CA); Vance Bao, St-Laurent (CA)

(73) Assignee: MEDISCA PHARMACEUTIQUE INC., Quebec (CA)

( * ) Notice: Subject to any disclaimer, the term of this patent is extended or adjusted under 35 U.S.C. 154(b) by 0 days.

(21) Appl. No.: 16/059,652

(22) Filed: Aug. 9, 2018

(65) Prior Publication Data

US 2018/0345305 A1 Dec. 6, 2018

Related U.S. Application Data

(63) Continuation-in-part of application No. PCT/CA2016/050179, filed on Feb. 23, 2016.

(51) Int. Cl.
*B05B 11/00* (2006.01)
*B05B 1/00* (2006.01)

(52) U.S. Cl.
CPC ..... *B05B 11/3008* (2013.01); *B05B 1/002* (2018.08); *B05B 11/3052* (2013.01);
(Continued)

(58) Field of Classification Search
CPC . B05B 11/3008; B05B 1/002; B05B 11/3052; B05B 11/00416; B05B 11/3023;
(Continued)

(56) References Cited

U.S. PATENT DOCUMENTS 2,805,798 A 9/1957 Sampson
3,020,938 A 2/1962 Ballin
(Continued)

FOREIGN PATENT DOCUMENTS

EP 3061209-0001 6/2016
EP 3061209-0002 6/2016
(Continued)

OTHER PUBLICATIONS

Clinical Deodorant Original Clean Product Page, https://www.priceline.com.au/dove-clinical-deodorant-original-clean-45-ml, page consulted on Feb. 11, 2016, 2 pages.
(Continued)

*Primary Examiner* — Paul R Durand
*Assistant Examiner* — Robert K Nichols, II
(74) *Attorney, Agent, or Firm* — Greenblum & Bernstein, P.L.C.

(57) ABSTRACT

A fluid dispenser, comprising: an actuator with a rotatable dial; a valve assembly connected to the actuator, the valve assembly being configured so as to cause fluid to be drawn from a reservoir and released from the dispenser during at least part of the time when the dial is rotated from a start position to one of a plurality of dosage positions and back to the start position, the plurality of dosage positions being at different respective angular positions of the dial; the actuator being configured to provide perceptible feedback at each of the plurality of dosage positions.

35 Claims, 39 Drawing Sheets

(52) U.S. Cl.
CPC ..... *B05B 11/00416* (2018.08); *B05B 11/3023* (2013.01); *B05B 11/3074* (2013.01)

(58) Field of Classification Search
CPC ..... B05B 11/3074; B05B 11/023; B05B 11/3005; A45D 40/0075; A45D 2200/054; A45D 2200/055; G01F 11/023
USPC ..... 222/39, 321.7, 321.8, 383.2, 410, 256, 222/309, 173
See application file for complete search history.

(56) References Cited

U.S. PATENT DOCUMENTS

| | | | |
|---|---|---|---|
| 3,458,090 | A | 7/1969 | Scoggin, Jr. |
| 4,185,755 | A | 1/1980 | Sachs et al. |
| 4,433,799 | A | 2/1984 | Corsette |
| 4,454,964 | A | 6/1984 | Sacher |
| 4,456,152 | A | 6/1984 | Young et al. |
| 4,595,124 | A | 6/1986 | Duval et al. |
| 4,865,591 | A | 9/1989 | Sams |
| 4,984,718 | A | 1/1991 | Cardia |
| 5,111,972 | A | 5/1992 | Sakurai et al. |
| 5,469,989 | A | 11/1995 | Graf et al. |
| 5,489,049 | A | 2/1996 | Robbins, III |
| 5,669,530 | A | 9/1997 | Cichon et al. |
| 6,039,483 | A | 3/2000 | Szekely |
| 6,273,152 | B1 | 8/2001 | Buehler et al. |
| 6,375,045 | B1 | 4/2002 | Ki |
| 6,443,331 | B1 | 9/2002 | DeJonge |
| 7,213,994 | B2 | 5/2007 | Phipps et al. |
| 7,303,348 | B2 | 12/2007 | Phipps et al. |
| 7,520,406 | B2 | 4/2009 | Jaichandra et al. |
| 8,485,397 | B2 | 7/2013 | Hammarin |
| 8,617,125 | B2 | 12/2013 | Christiansen |
| 2006/0278663 | A1 | 12/2006 | Mink et al. |
| 2007/0175917 | A1 | 8/2007 | Bonney et al. |
| 2009/0326442 | A1 | 12/2009 | Ross et al. |
| 2010/0324498 | A1 | 12/2010 | Christiansen |
| 2013/0082071 | A1 | 4/2013 | Ritzenhoff et al. |
| 2014/0221945 | A1 | 8/2014 | Dos Santos et al. |
| 2014/0323993 | A1 | 10/2014 | Wilcox et al. |

FOREIGN PATENT DOCUMENTS

| | | |
|---|---|---|
| EP | 3061209-0003 | 6/2016 |
| WO | 2008071804 | 6/2008 |
| WO | WO2015133822 A1 * | 3/2015 |

OTHER PUBLICATIONS

Topi Click, news and updates, http://www.topi-click.com, page consulted on Feb. 11, 2016, 1 page.
Topi Click, user instructions, http://www.topi-click.com, page consulted on Feb. 11, 2016, 1 page.
Restriction Requirement dated Dec. 6, 2017 for Design U.S. Appl. No. 29/550,220, 10 pages.
International Search Report dated Oct. 28, 2016 for PCT/CA2016/050179, 3 pages.

* cited by examiner

DISPENSING CONTAINER AND ACTUATOR THEREFOR

CROSS-REFERENCE TO RELATED APPLICATION

The present application is a continuation-in-part of International Application No. PCT/CA2016/050179, filed on Feb. 23, 2016, hereby incorporated by reference herein. Benefit is claimed under 35 U.S.C. 120.

FIELD

The present invention relates generally to dispensing containers and, in particular, to dispensing containers for fluids such as creams and ointments, and to dispensers and actuators for use in such containers.

BACKGROUND

Dispensers for dispensing fluids such as creams and ointments exist. A drawback of existing dispensers is that they are unsatisfactory in terms of their accuracy, and/or preciseness, and/or controllability in terms of the amount of fluid they dispense from a container such as a bottle. As a result, such dispensers are not suitable for creams or ointments that are medicated and may require that they be dispensed in a prescribed dose which itself may vary over the duration of treatment.

When control over how much fluid to dispense is desired, users sometimes resort to approaches such as the use of a syringe, dropper or other measuring device. However, the act of directly accessing the product from a jar or bottle may contaminate the user as well as contaminate or oxidize the remaining product, which accelerates spoilage and leads to increased costs for the user. In specific applications, the use of a syringe, dropper or other measuring device may further require significant patient compliance to ensure a correct dosage administration.

As such, existing techniques for dispensing fluids in certain applications are unsatisfactory.

SUMMARY

According to a first aspect, there is provided a fluid dispenser, comprising: an actuator with a rotatable dial; a valve assembly connected to the actuator, the valve assembly being configured so as to cause fluid to be drawn from a reservoir and released from the dispenser during at least part of the time when the dial is rotated from a start position to one of a plurality of dosage positions and back to the start position, the plurality of dosage positions being at different respective angular positions of the dial; the actuator being configured to provide perceptible feedback at each of the plurality of dosage positions.

According to a second aspect, there is provided an actuator for a fluid dispenser, comprising: a housing attachable to a casing; a dial mounted to the housing; and a component mounted to the housing and attachable to a valve assembly configured to carry fluid from the casing towards an egress port of the actuator; wherein the dial and the component have respective contacting surfaces that are configured to urge the component to undergo axial displacement as the dial is rotated; wherein the housing is configured to impede rotational motion of the component relative to the housing while the component undergoes said axial displacement; and wherein the contacting surfaces being are further configured to provide perceptible feedback at a plurality of angular displacements of the dial.

According to a third aspect, there is provided a dispensing container, comprising: a casing having a dimension along a longitudinal direction; and a fluid dispenser mounted to the casing and configured so as to cause fluid to be drawn from a reservoir disposed within the casing and released towards an exterior of the container via the fluid dispenser during at least part of the time when an element of the fluid dispenser is rotated from a start position to one of a plurality of angularly spaced-apart dosage positions and back to the start position; wherein the fluid dispenser is configured to provide perceptible feedback at each of the plurality of dosage positions.

According to a fourth aspect, there is provided a method, comprising: setting a dosage selector of a dispenser to a first dosage position; rotating a component of the dispenser from a start position until blocked by the dosage selector in the first position and back to the start position, thereby to cause a first amount of fluid to be dispensed by the dispenser; releasing the dosage selector from the first dosage position, and setting the dosage selector to a second dosage position; and rotating the component from the start position until blocked by the dosage selector in the second position and back to the start position, thereby to cause a second amount of fluid to be dispensed by the dispenser, the second amount of fluid being different than the first amount of fluid.

These and other aspects and features of the present invention will now become apparent to those of ordinary skill in the art upon review of the following description of specific embodiments of the invention in conjunction with the accompanying drawings.

It is to be expressly understood that the description and drawings are only for the purpose of illustration of certain embodiments of the invention and are an aid for understanding. They are not intended to be a definition of the limits of the invention.

DETAILED DESCRIPTION

The following provides a description of various non-limiting embodiments of a container for dispensing cream, ointment, lotion, emulsion, gel or any other topical formulation or other fluid.

Version 1

Figure 1A:
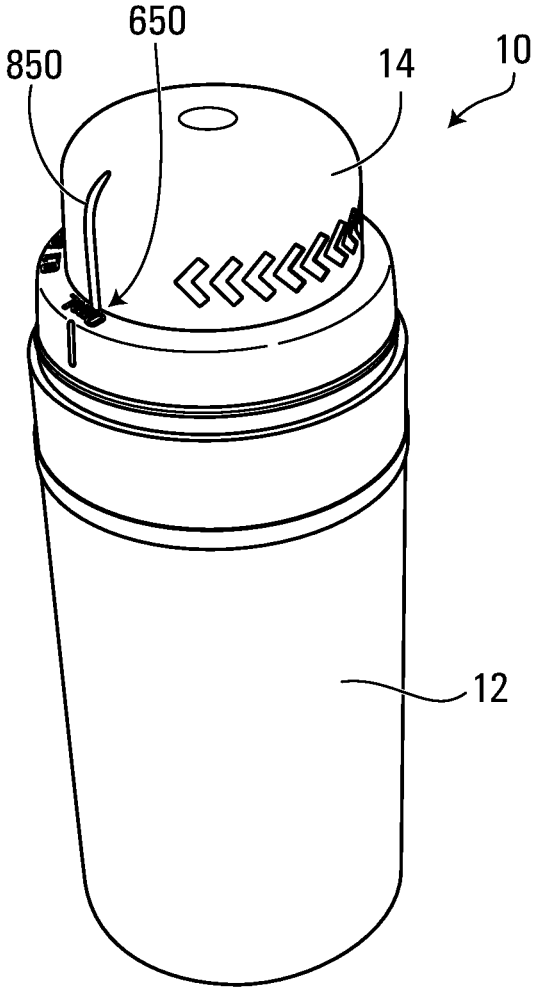
FIG. 1A is a perspective view of a dispensing container in accordance with a non-limiting embodiment, the container including a casing and a dispenser.
Figure 1B:
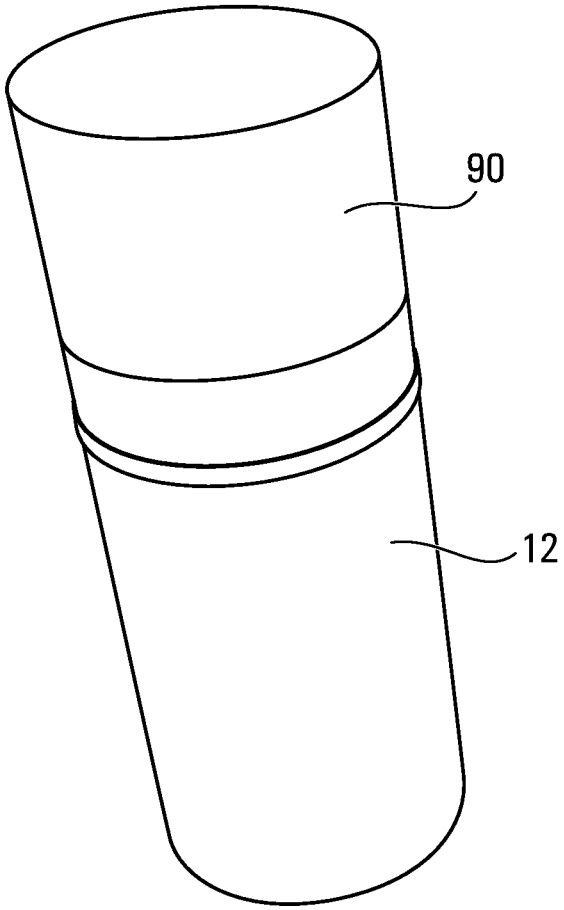
FIG. 1B is a perspective view of the dispensing container of FIG. 1A with a cap mounted thereon.
Figure 17:
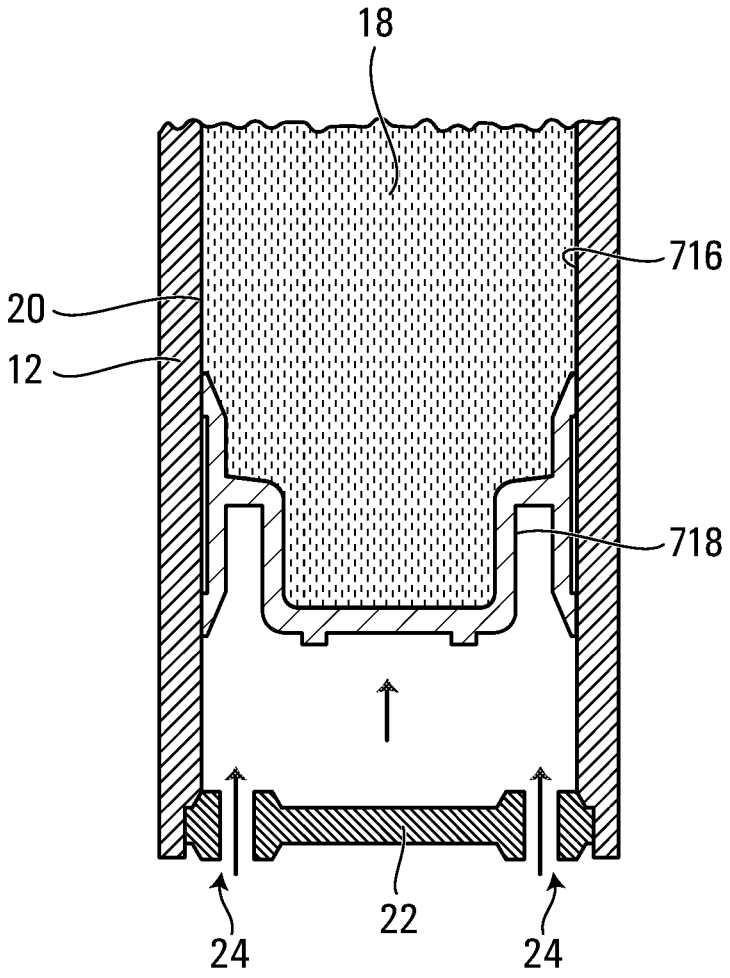
FIG. 17 is a partial side elevational cross-sectional view of the valve assembly, in accordance with a non-limiting embodiment, illustrating a release of negative pressure formed by axial movement of a reservoir of the valve assembly relative to the casing of the container.

With reference to FIGS. 1A, 1B and 17, there is shown a dispensing container 10 in accordance with a non-limiting embodiment. The dispensing container may be a bottle or a jar, and comprises a casing 12 to which is mounted a dispenser 14 for dispensing fluid contained in reservoir 18. The fluid contained in the reservoir 18 may be a cream, ointment, lotion, emulsion, gel or any other topical formulation or other fluid. The reservoir 18 may be movable within an inner wall 20 of the casing 12. In use, the reservoir 18 migrates upwards towards the dispenser 14 as the volume of fluid it contains decreases. In some embodiments, the container 10 may further include a bottom end 22. The bottom end 22 may include one or more vents 24 to equalize a pressure differential caused by displacement of a base 718 of the reservoir 18 towards the dispenser 14 as the volume of fluid held in the reservoir 18 decreases during use. In other embodiments, the bottom end 22 of the container 10 may be omitted, rendering the casing 12 a bottomless casing.

The container 10 may be generally in the form of a cylinder with a longitudinal axis and two ends, such that the dispenser 14 is located at one longitudinal end of the container 10. However, other shapes and configurations are possible. The container 10 may be made of a plastic or any other suitable material. The container 10 may be see-through or opaque. By way of non-limiting example, certain components of the container 10 may be moulded or 3D-printed. In some embodiments, a cap 90 may optionally be disposed atop the dispenser 14 for purposes of concealment or protection.

Figure 2:
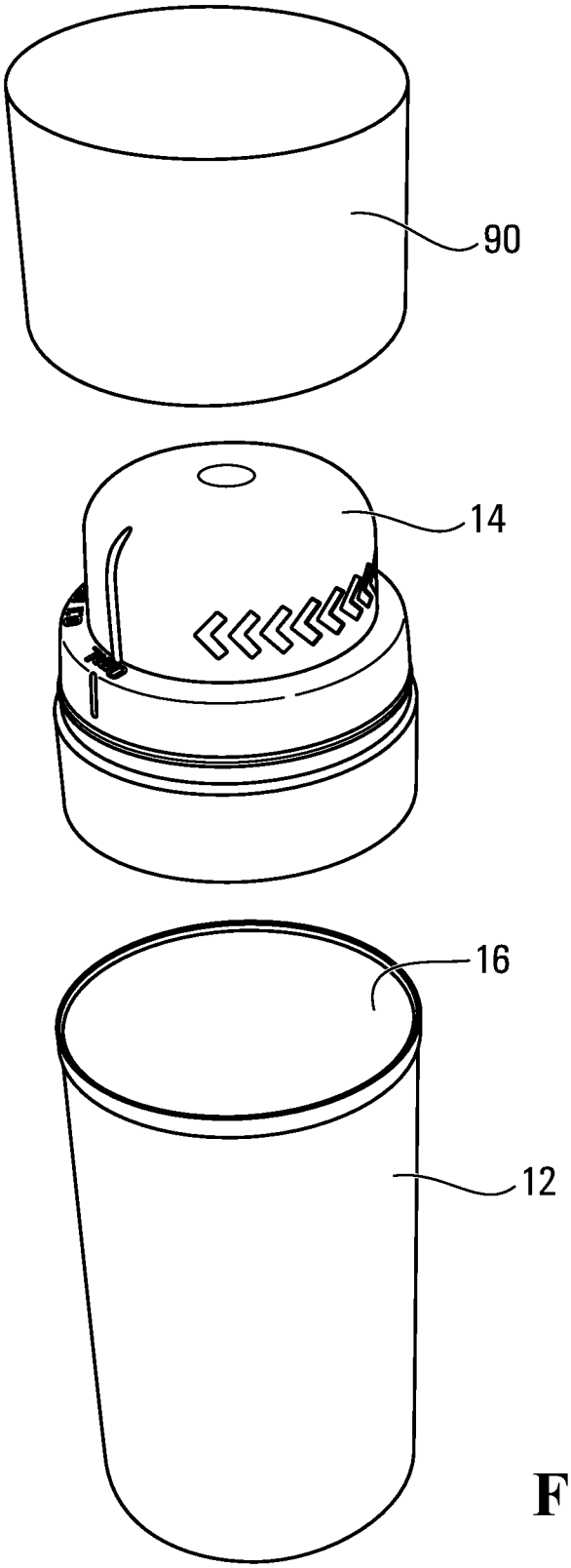
FIG. 2 is an exploded perspective view of the dispensing container of FIG. 1B, showing the cap, the casing and the dispenser.

With reference to FIG. 2, the dispensing container 10 and optional cap 90 are shown in exploded view. It will be appreciated that once assembled onto the casing 12, the dispenser 14 creates a substantially hermetic seal, which in specific implementations, may advantageously minimize tampering, contamination and oxidation of the fluid contained therein.

Figure 3:
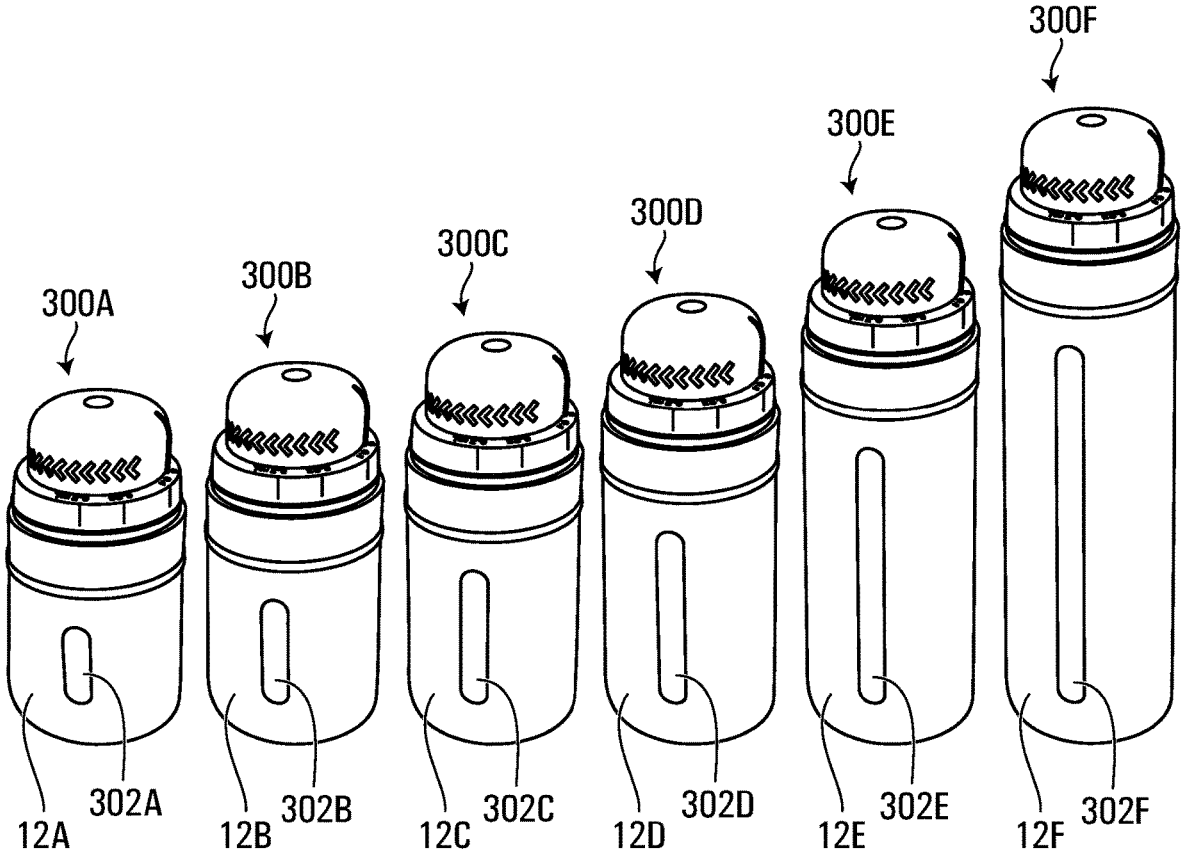
FIG. 3 is a perspective view of a plurality of containers of different sizes and each including a fill window, in accordance with various non-limiting embodiments.

Moreover, as shown in FIG. 3, the dispenser 14 is modular and can be used with casings 12A-12F capable of holding different volumes, but having the same size mouth 16.

Figure 5:
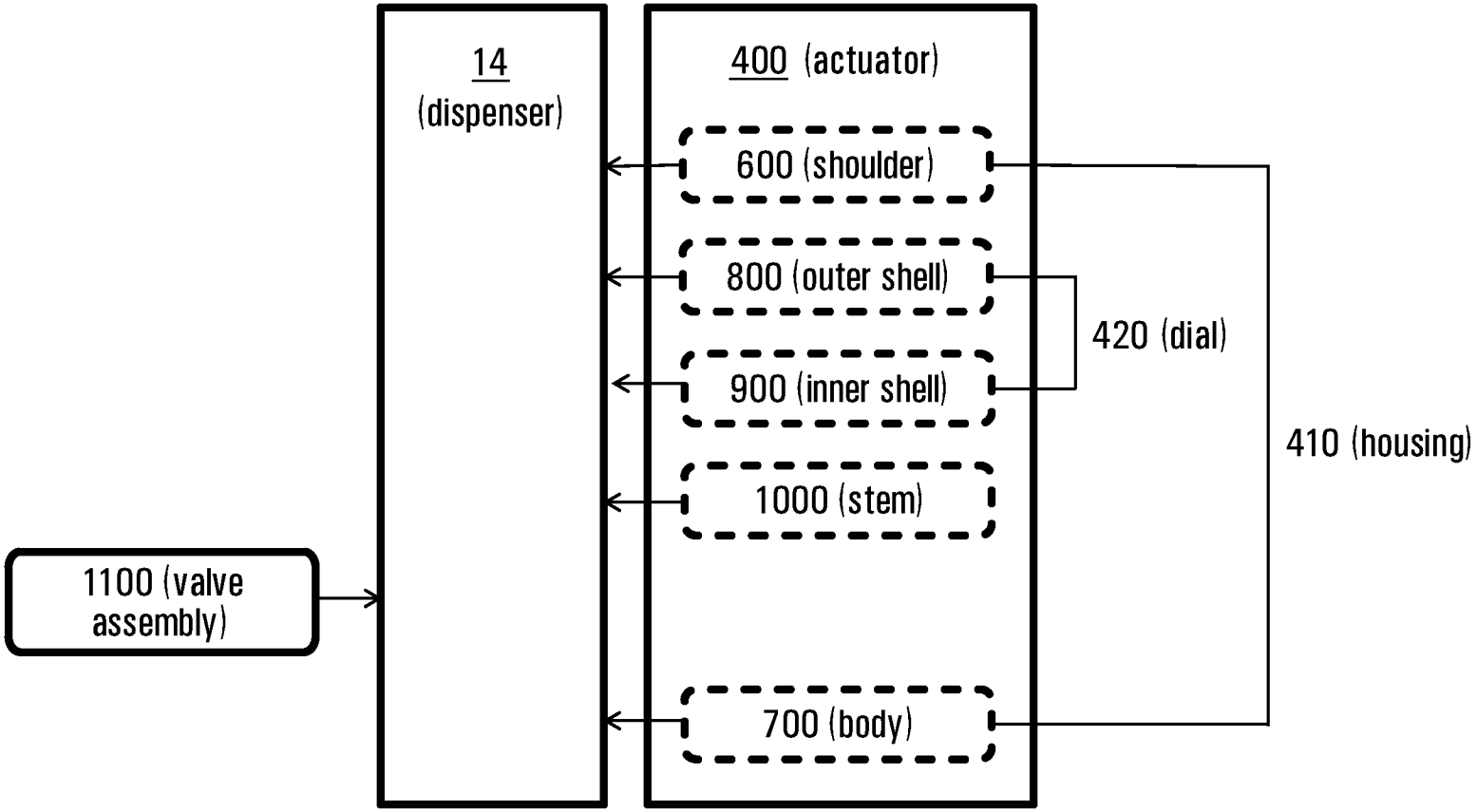
FIG. 5 is a block diagram illustration of the actuator including a housing body, a housing shoulder, a dial inner shell, a dial outer shell and a stem, in accordance with a non-limiting embodiment.

Turning now to FIG. 5, the dispenser 14 comprises an actuator 400 and a valve assembly 1100. In the present non-limiting embodiment, the actuator 400 includes a housing 410 attachable to the casing 12, a rotatable dial 420 mounted to the housing 410 and a stem 1000 in contact with both the dial 420 and the housing 410. The housing 410 includes a shoulder 600 and a body 700, while the dial includes an outer shell 800 and an inner shell 900. The body 700, the shoulder 600, the outer shell 800, the inner shell 900 and the stem 1000 will now be described in the context of a non-limiting embodiment of the present invention.

With reference to FIGS. 1B, 2, 4 and 6B, the cap 90 may have a circular opening defined by a ring of a certain thickness that rests atop a circular ledge 692 formed by the shoulder 600. The ledge 692 creates a thin, lowered region at a wider diameter surrounding the upper ring 602 which has a narrower diameter. With proper dimensioning of the outer surface of the upper ring 602 of the shoulder 600 and the inner surface of the opening of the cap 90, the cap 90 can be made to fit snugly to the dispenser 14. In other embodiments, the cap 90 may be a screw-on cap, including for example a child-resistant cap. The cap 90 has an outer surface that may be designed in thickness to be flush with the outer surface of the casing 12 when the cap 90 is mounted to the dispenser 14, which may give a sleek look to the container 10.

Figure 4:
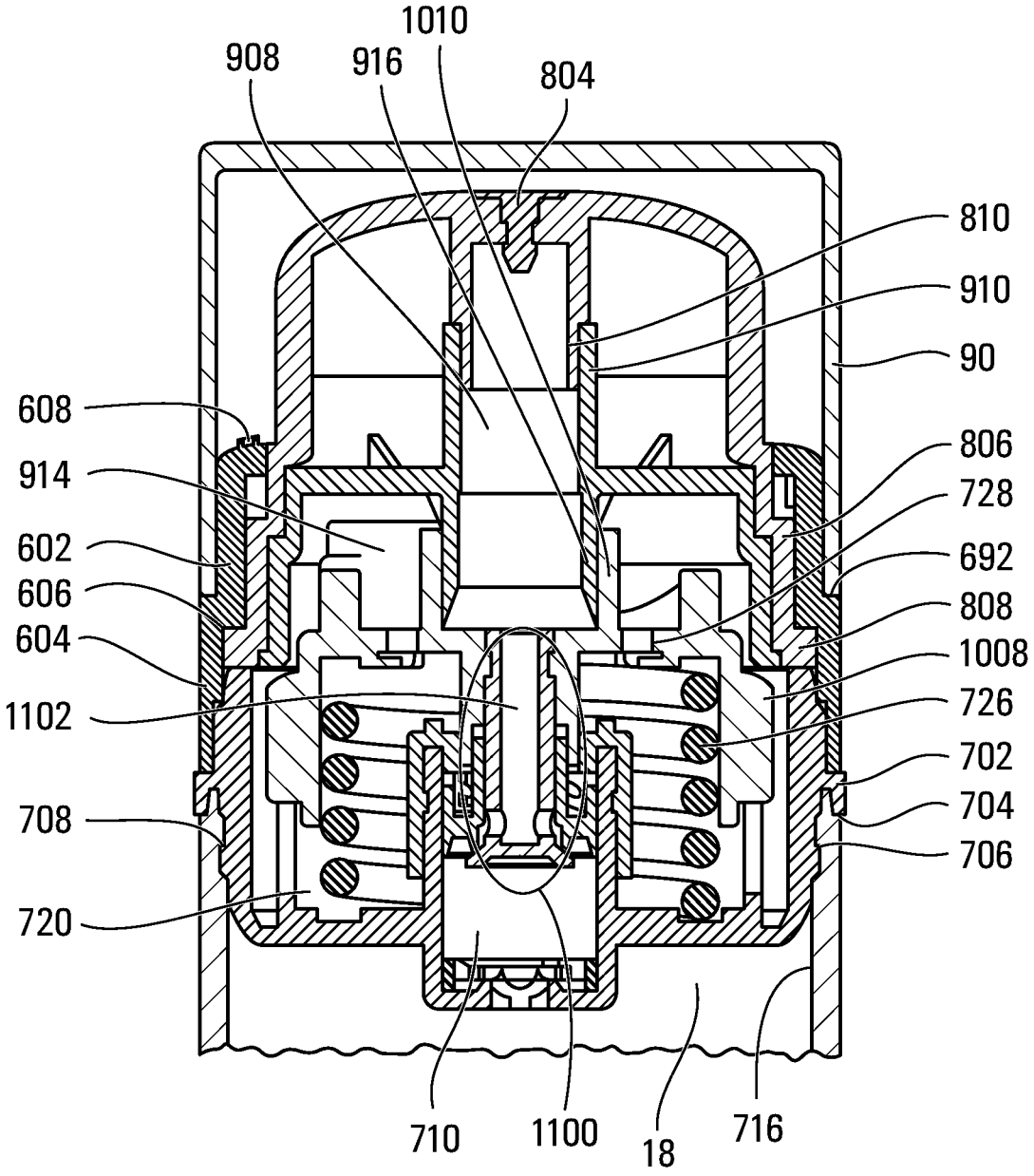
FIG. 4 is a cross-sectional view of the dispenser, including an actuator and a valve assembly, in accordance with a non-limiting embodiment.
Figure 7A:
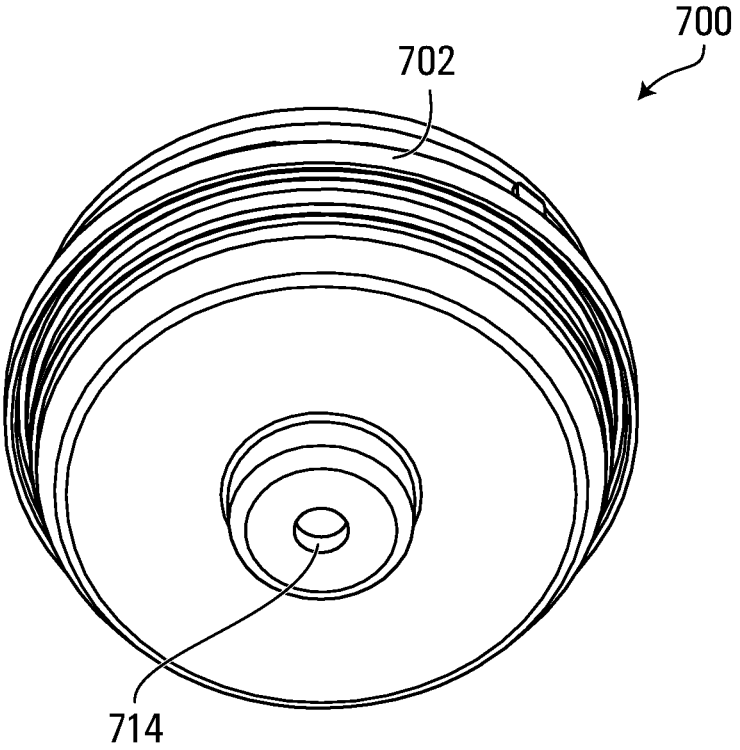
FIGS. 7A and 7B are bottom and top perspective views, respective, of the body of the housing of the actuator, in accordance with a non-limiting embodiment.
Figure 7B:
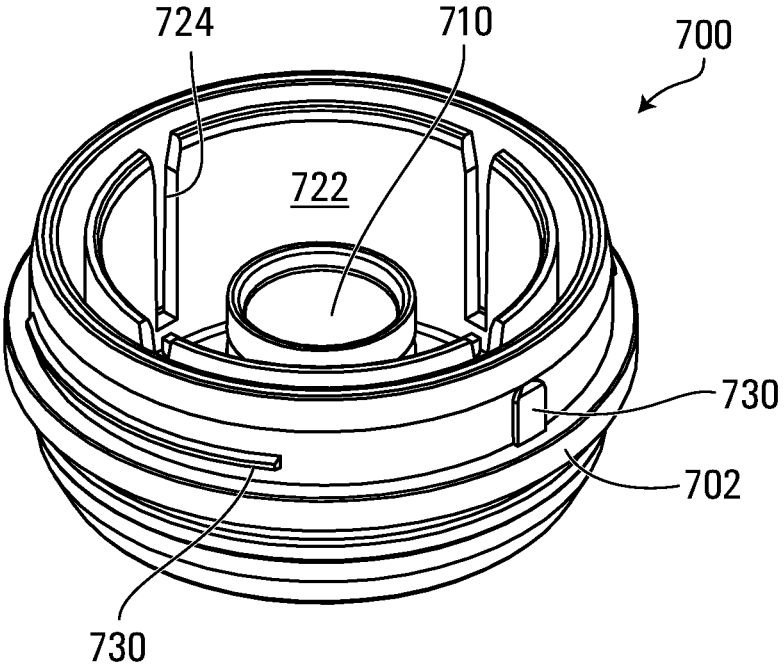

With reference to FIGS. 4 and 7A-7B, the body 700 includes an annular shell with a flange 702 around its periphery, conceptually dividing the annular shell into a top ring and a bottom ring. The flange 702 is recessed therebeneath to accommodate a thinned outer wall 704 at the mouth 16 of the casing 12. The flange 702 is designed to have an outer diameter that corresponds to the outer diameter of the casing 12, so that an exterior of the body 700 (i.e., the surface of the flange 702) is flush with the exterior of the casing 12 when the body 700 is mounted thereto. In order to secure the body 700 to the casing 12, the inner wall of the casing 12 includes one or more dimples or tracks 706 which accommodate complementary projections 708 on the surface of the body 700 below the flange 702. By urging the body 700 downwards onto the casing 12 while the projections 708 are axially aligned with the dimples or tracks 706, the projections 708 ultimately enter the dimples or tracks 706 and the body 700 snaps onto the casing 12.

Towards an interior of the body 700, there is provided a cylindrical chamber 710 that accommodates the valve assembly 1100. The chamber 710 is connected to the reservoir 18 via an orifice 714 in the body 700. The reservoir 18 is defined by a cylindrical inner wall 716 of the casing 12 and a base 718 (see FIG. 17). The reservoir 18 normally contains fluid to be dispensed by the dispenser 14.

The cylindrical chamber 710 is surrounded by a moat 720 which is itself surrounded by a thin cylindrical wall 722 comprising axial slots 724. The moat 720 accommodates a spring 726 which can be compressed by downwards axial motion of a stem undersurface 728 (see FIG. 10A).

The shoulder 600 is separate from the body 700 but snaps to the body 700 when assembly of the actuator 400 is complete. With additional reference to FIGS. 6A and 6B, the shoulder 600 generally includes an upper ring 602 that sits on top of a lower ring 604, the lower ring 604 having an outer diameter larger than the outer diameter of the upper ring 602 and having an inner diameter larger than the inner diameter of the upper ring 602, thus forming an annular lip 606 on the inside of the shoulder 600. The upper ring 602 includes a radially inwardly facing ledge 608, on which information about a start position, dosages and/or other information may be printed, embossed or debossed.

The lower ring 604 of the shoulder 600 includes a plurality of recesses or dimples 610 while the top ring of the body 700 includes complementary protrusions 730 (see FIG. 7B) that are configured to snap into these dimples/recesses 610 when the shoulder 600 and the body 700 are urged together. The size of the outer diameter of the lower ring 604 corresponds to the size of the outer diameter of the casing 12 and also to the outer diameter of the flange 702 of the body 700. In this way, when the shoulder 600 is mated to the body 700, the resulting container 10 including the casing 12 and the actuator 400 presents a smooth and uniform outer surface.

For purposes of assembly of the actuator 400 and/or the dispenser 14, the shoulder 600 and the body 700 are mated to another (i.e., the dimples/recesses 610 of the lower ring 604 of the shoulder 600 engage the protrusions 730 of the top ring of the body 700), however this is done only once the stem 1000, the valve assembly 1100 and the dial 420 are set in place.

Figure 8A:
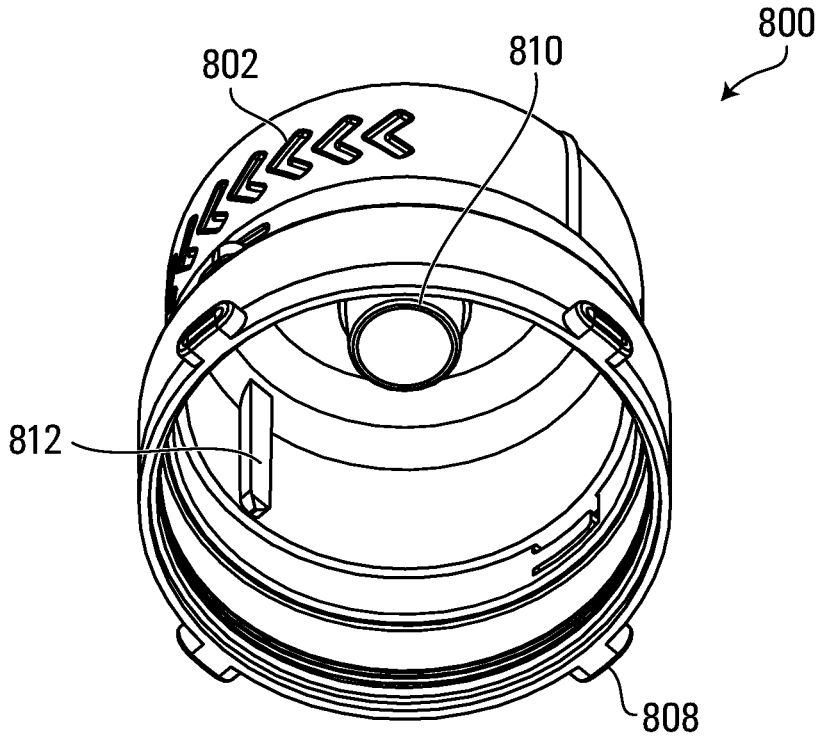
FIGS. 8A and 8B are bottom and top perspective views, respective, of the outer shell of the dial of the actuator, in accordance with a non-limiting embodiment.

The dial's outer shell 800 is rotated by the user during operation of the actuator 400. With additional reference to FIGS. 8A and 8B, the outer shell 800 may include a textured surface to facilitate gripping, such as a relief pattern 802, although other grip facilitating features could be provided, such as areas of surface depression, wings, knobs, etc. The outer shell 800 also includes at least one egress port 804 through which fluid exits the actuator 400. Fluid dispensing could occur upon turning the dial 800 in one rotational direction (e.g., clockwise), in an opposite rotational direction, or in both. The shape of the egress port 804 is not particularly limiting, and may be in the form of a ring, one or more holes, one or more slits, etc. Also, while in the illustrated embodiment, the egress port 804 is centered, this need not be the case in all embodiments.

The outer shell 800 of the dial 420 further includes a circular band 806 around its outer surface. Also, the outer shell 800 includes a plurality of feet 808 that protrude radially outward at a base of the outer shell 800. When the outer shell 800 is inserted through the shoulder 600, the circular band 806 comes up against the ledge 608 formed by the upper ring 602 of the shoulder 600, while the feet 808 come up against the annular lip 606 on the inside of the shoulder 600. When, in addition, the body 700 is snapped to the shoulder 600, the feet 808 of the outer shell 800 are now caught between the annular lip 606 on the inside of the shoulder 600 and the top ring of the body 700. This blocks axial displacement of the dial's outer shell 800 relative to the housing 410 while permitting rotational motion of the dial 420 relative to the housing 410. Axial displacement can refer to displacement along an axis that is normal to a plane of rotation of the dial 420.

Figure 9A:
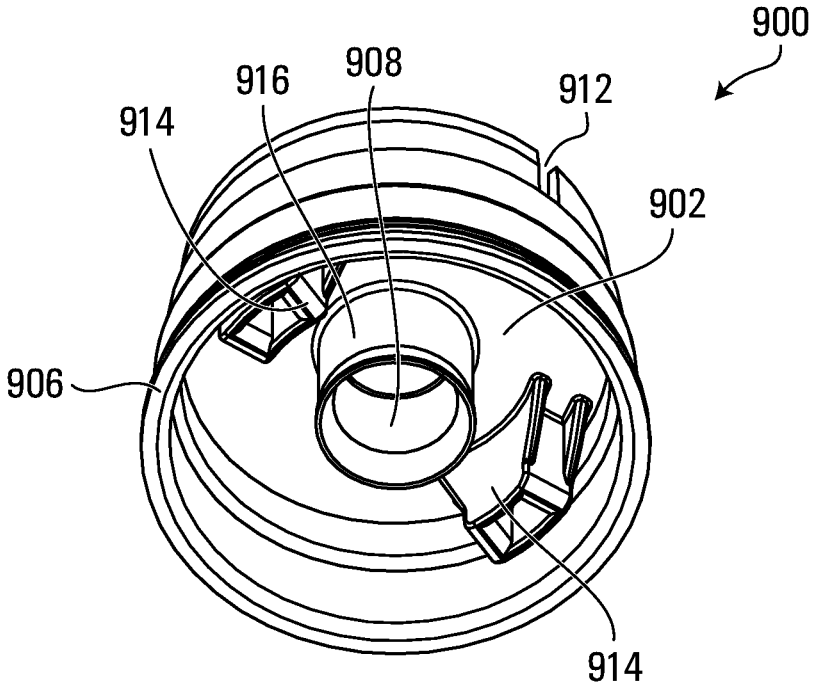
FIGS. 9A and 9B are bottom and top perspective views, respective, of the inner shell of the dial of the actuator, in accordance with a non-limiting embodiment.
Figure 9B:
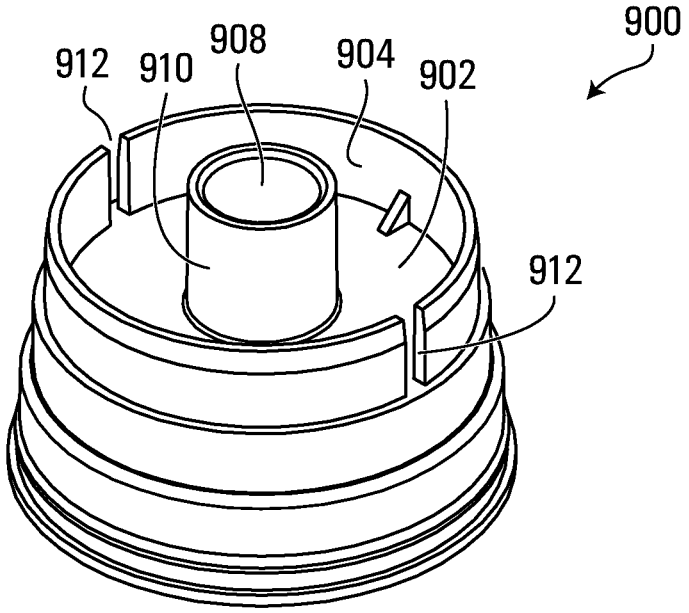

With additional reference to FIGS. 9A-9B, the inner shell 900 of the dial 420 includes a disk 902 circumscribed by an upper wall 904 on the periphery of an upper surface of the disk 902 and a lower wall 906 on the periphery of an underside of the disk 902. A cylindrical channel 908 passes longitudinally through a center of the disk 902. The inner shell 900 is mounted to the outer shell 800 through a pair of mating, hollow cylindrical connectors, a first one 810 on the outer shell 800 of the dial 420 and a second one 910 on the inner shell 900. The hollow cylindrical mating connector 810 on the outer shell 800 passes through a center of the dial 420 and creates a conduit for fluid towards the egress port 804. Engagement of the connectors 810, 910 acts as a stop against axial motion of the inner shell 900 relative to the outer shell 800. Also, rotational motion of the inner shell 900 relative to the outer shell 800 is blocked by a set of axially oriented ribs 812 disposed on an inner surface of the outer shell 800 and a corresponding set of axially oriented slits 912 located on the upper wall 904 on the periphery of the upper surface of the disk 902 of the inner shell 900. Thus, when the ribs 812 of the outer shell 800 are aligned with the slits 912 of the inner shell 900, the inner shell 900 can be pushed towards the outer shell 800 from the inside, resulting in engagement of the cylindrical mating connectors 910, 810. At this point, practically speaking, the outer shell 800 and the inner shell 900 form one and the same component, namely the dial 420.

The inner shell 900 of the dial 420 also includes a plurality of hanging arms, in this case two such hanging arms 914 disposed at 180 degrees to one another. Each of the hanging arms 914 occupies a certain arc length (e.g., around 10 degrees) around an outer periphery of the circular surface on the underside of the disk 902. In other embodiments, there may be a single hanging arm 914, while in still other embodiments, there may be more than two hanging arms.

Figure 10A:
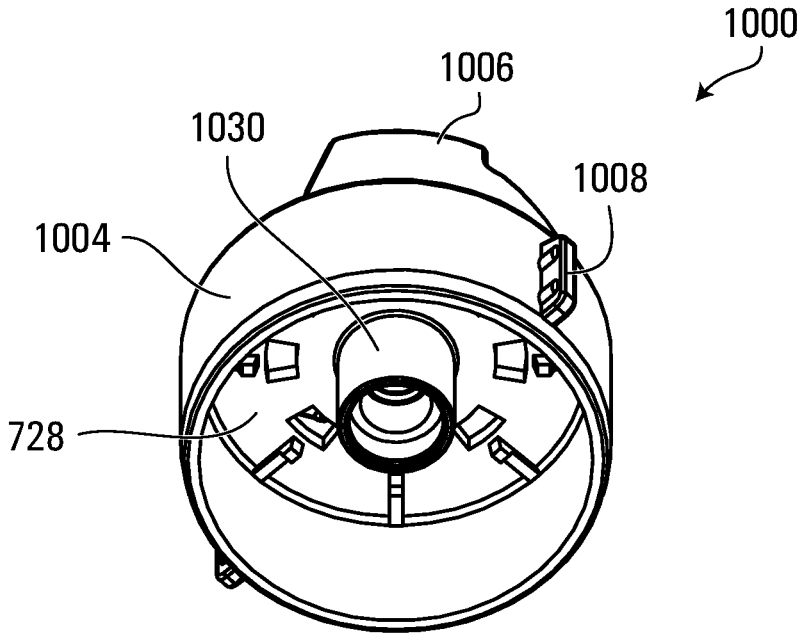
FIGS. 10A and 10B are bottom and top perspective views, respectively, of the stem of the actuator, in accordance with a non-limiting embodiment.
Figure 10B:
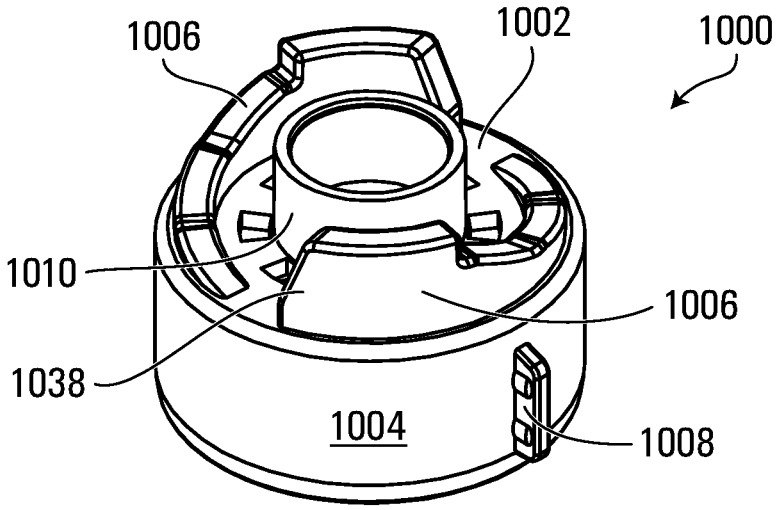

Turning now to the stem 1000, and with additional reference to FIGS. 10A-10B, this cap-shaped component includes a disk 1002 under which hangs a cylindrical outer wall 1004. On top of the disk 1002 is a plurality of contoured ridges. In this case, there are two contoured ridges 1006 that are at 180 degrees apart around a periphery of the disk 1002. In other embodiments, there may be a single contoured ridge 1006, while in still other embodiments, there may be more than two contoured ridges. The stem 1000 and the inner shell 900 of the dial 420 are in contact through a pair of mating, hollow cylindrical connectors, one connector 1010 being on the stem 1000 and the other connector 916 being on the inner shell 900. The hollow cylindrical mating connectors 1010, 916 pass through a center of the dial 420 and create a conduit for passage of fluid towards the egress port 804 of the dial 420.

The stem 1000 also includes wings 1008 that slide into the aforementioned axial slots 724 made in the thin cylindrical wall 722 of the body 700, which blocks rotational motion of the stem 1000 relative to the body 700 (and also relative to the housing 410 as a whole).

Although the dial 420 is permitted to move rotationally relative to the housing 410, it is blocked by the housing 410 from moving axially. (In the present description, the terms "axial" and "longitudinal" are sometimes used interchangeably.) Specifically, the feet 808 of the dial's outer shell 800 are sandwiched between the annular lip 606 on the inside of the shoulder 600 and the top ring of the housing's body 700. For its part, the stem 1000 is permitted to move axially within a certain range of motion, but is blocked by the housing 410 from rotating. This blocking is achieved by the wings 1008 of the stem being caught in the axial slots 724 of the housing's body 700.

By proper configuration of the inner shell 900 of the dial 410 and of the stem 1000, a transfer of rotational motion of the dial 420 to axial motion of the stem 1000 can be achieved. Specifically, the stem 1000 and the inner shell 900 of the dial 420 are in contact with each other through the hanging arms 914 of the inner shell 900 and the contoured ridges 1006 of the step 1000, which act as cams. The hanging arms 914 are shaped in such a way that when the dial 420 is rotated, rotation of the hanging arms 914 pushes obliquely against the surface of the contoured ridges 1006. Since the stem 1000 cannot rotate, the rotational force that it receives from the hanging arms 914 is redirected by the oblique shape of the contoured ridges 1006, urging the stem 1000 to undergo a "downwards" axial displacement (away from the dial 420). Also subjected to this downwards axial displacement of the stem 1000 is a cylindrical base 1030 that interacts with the valve assembly 1100.

As shown in FIG. 4, the valve assembly 1100 can be an airless valve assembly incorporating a reciprocating piston rod 1102. The valve assembly 1100 is configured to draw fluid from the reservoir 18 by suction and push it through a hollow portion of the piston rod 1102, through the stem 1000 and ultimately out through the egress port 804 of the outer dial 800.

In this embodiment, the valve assembly is of the type that expels fluid as a result of upward axial displacement of the piston rod 1102, i.e., this occurs during a return stroke of the piston rod 1102, namely, during decompression of the spring 726. However, other valve assemblies are possible. For example, another possible valve assembly is configured to push fluid through the stem 1000 upon downward axial displacement of a piston rod (i.e., during compression of the spring 726). Yet another possible valve assembly is configured to expel fluid upon both downward and upward axial displacement of a piston rod, for example in respective fluid volume ratios (resulting from the downward:upward axial displacement of the piston rod) of 50:50, 90:10, 80:20, 70:30, 60:40, 40:60, 30:70, 20:80, 10:90, and the like. Each of these valve assemblies may be suitable in different embodiments. Still other valve assemblies may be based on the valve assembly described in U.S. Pat. No. 6,375,045, hereby incorporated by reference herein.

As an aid in understanding, a specific non-limiting embodiment of a valve assembly is now described with reference to FIG. 11, which shows a valve assembly 1100A. It should be noted that the valve assembly 1100A is a variant of the valve assembly 1100 because it is of the type that expels fluid on a downward (rather than upward) stroke of a piston rod. Persons skilled in the art will know what variations are needed in order to change the valve assembly so that it becomes of the type that expels fluid on the return stroke of the piston rod 1102A. In the following, a reference to a component of the actuator 400 is labelled with a suffix "A", since the design of this component may be slightly different in order to accommodate the specific type of valve assembly being described in the embodiment of FIG. 11 when compared with the one provided for in FIG. 4.

Figure 11:
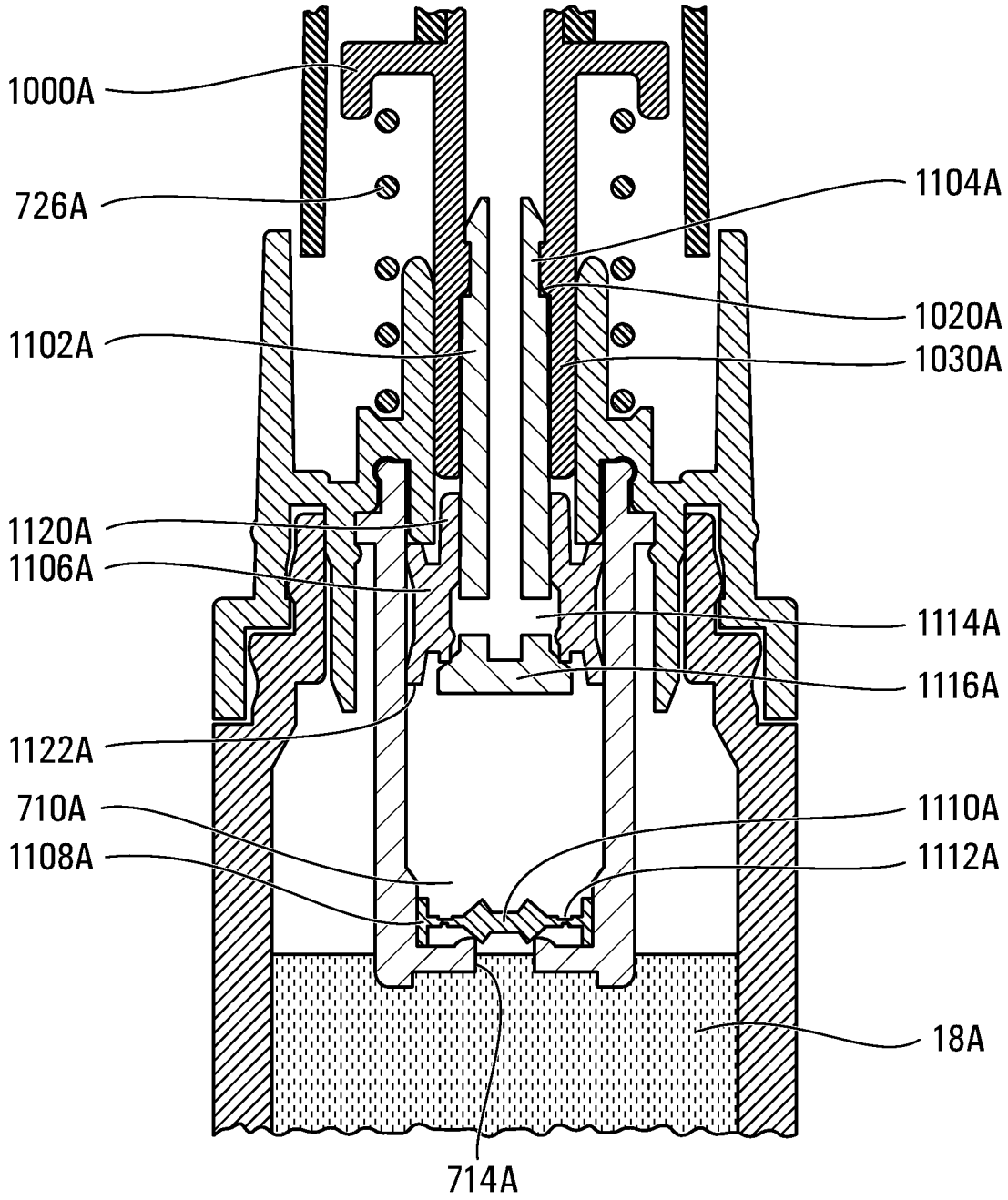
FIG. 11 is a side elevational cross-sectional view of the valve assembly, in accordance with a non-limiting embodiment.

Thus, with reference to FIG. 11, the valve assembly 1100A includes a piston rod 1102A connected to the stem 1000A. The piston rod 1102A of the valve assembly 1100A is secured to the cylindrical base 1030A of the stem 1000A by virtue of a protruding ring 1020A of the stem 1000A being caught in a circular recess 1104A of the piston rod 1102A. Thus, when the stem 1000A undergoes downwards axial displacement, so too does the piston rod 1102A of the valve assembly 1100A; similarly, when the stem 1000A undergoes upwards axial displacement, so too does the piston rod 1102A of the valve assembly 1100A. The valve assembly 1100A also comprises a seal cap 1106A disposed circumferentially near the top of the chamber 710A and a check valve 1108A disposed circumferentially at the bottom of the bottom of the chamber 710A. The seal cap 1106A is slidably mounted to an inner wall of the chamber 710A so that axial motion of the seal cap 1106A relative to the inner wall of the chamber 710A is permitted. Axial motion in the downwards direction is caused by the base 1030A of the stem 1000A pushing down on an upper portion 1120A of the seal cap 1106A. Axial motion in the upwards direction is caused by a base 1116A of the piston rod 1102A pushing up on a lower portion 1122A of the seal cap 1106A. The seal cap 1106A provides a seal against fluid leakage between the inner wall of the chamber 710A and the piston rod 1102A. The check valve 1108A has a plug 1110A that nominally blocks the orifice 714A of the body 700A but is sufficiently flexible to be raised and dislodged from the orifice 714A. The check valve 1108A also has one or more eccentric openings 1112A. The check valve 1108A is made of a material that is sufficiently flexible to allow fluid to be drawn into the chamber 710A from the reservoir 18A via the orifice 714A and the eccentric openings 1112A (with the plug 1110A raised) but does not permit fluid to be pushed out from the chamber 710A into the reservoir 18A. The piston rod 1102A acts as a conduit for fluid traveling from the chamber 710A to the stem 1000A. To this end, the piston rod 1102A includes one or more openings 1114A near the base 1116A.

Figure 13A:
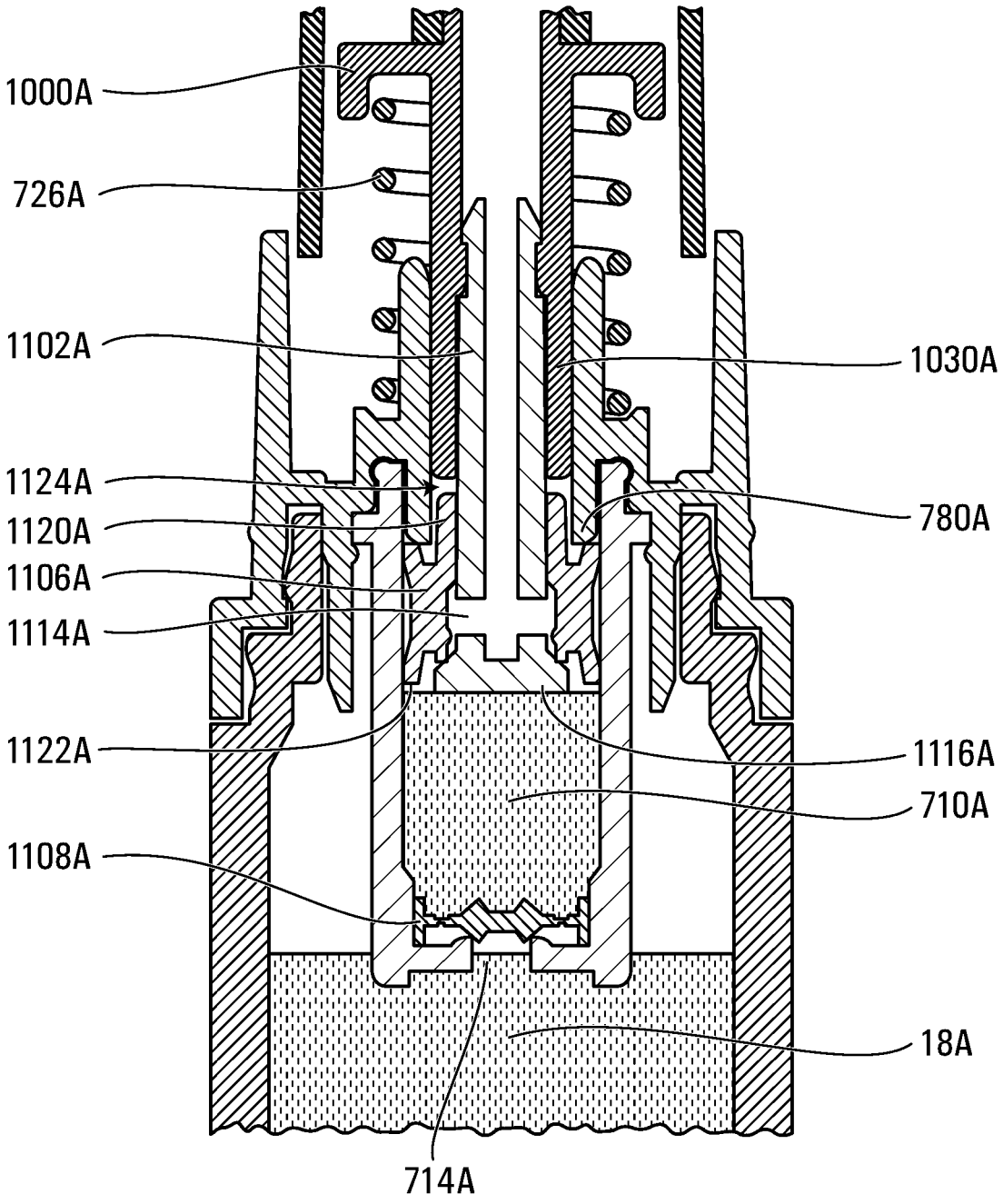
FIGS. 13A to 13C are side elevational cross-sectional views of the valve assembly, in accordance with a non-limiting embodiment, at different points along the trajectory of the dial from a start position to a selected dosage position.
Figure 13B:
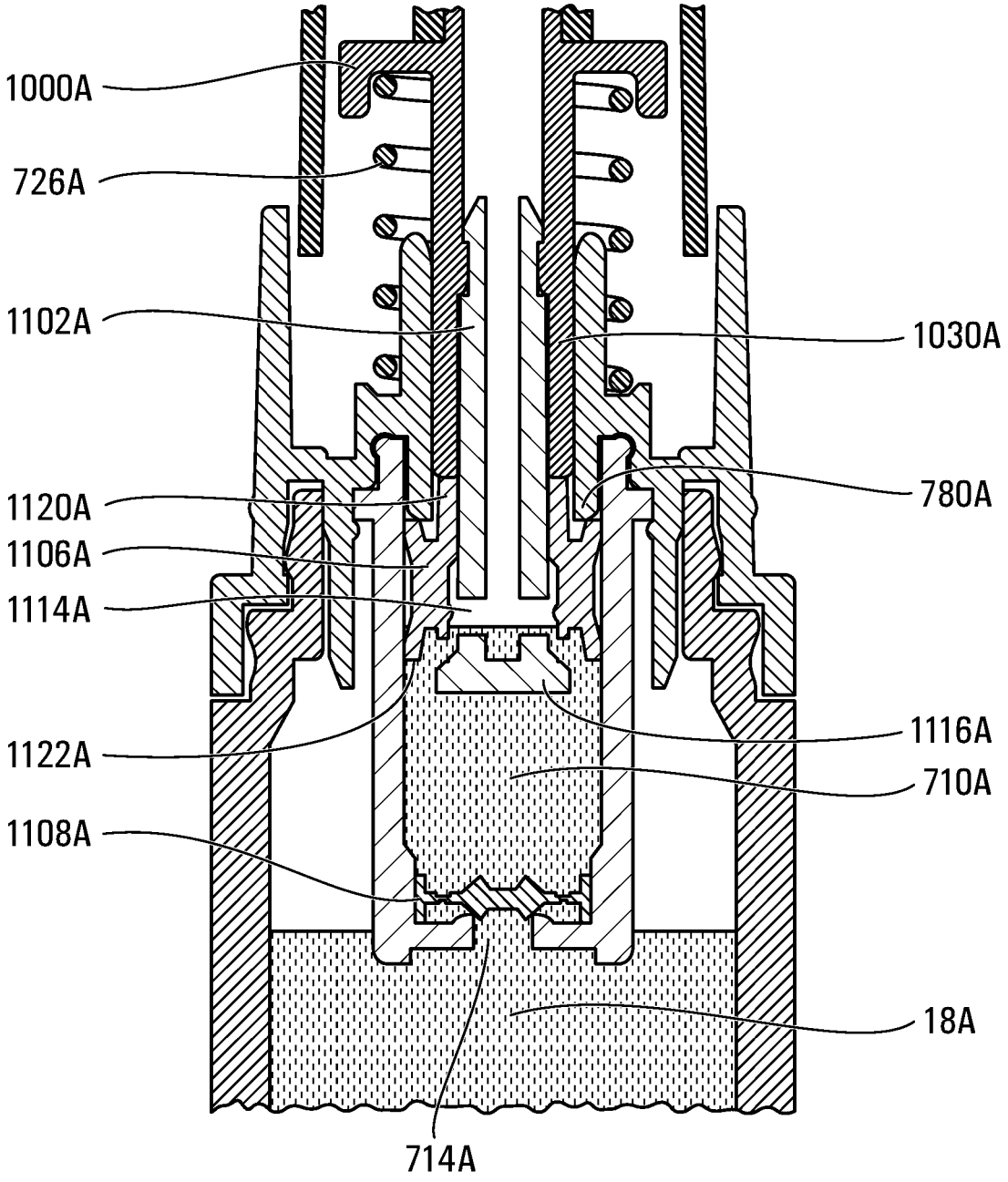
Figure 13C:
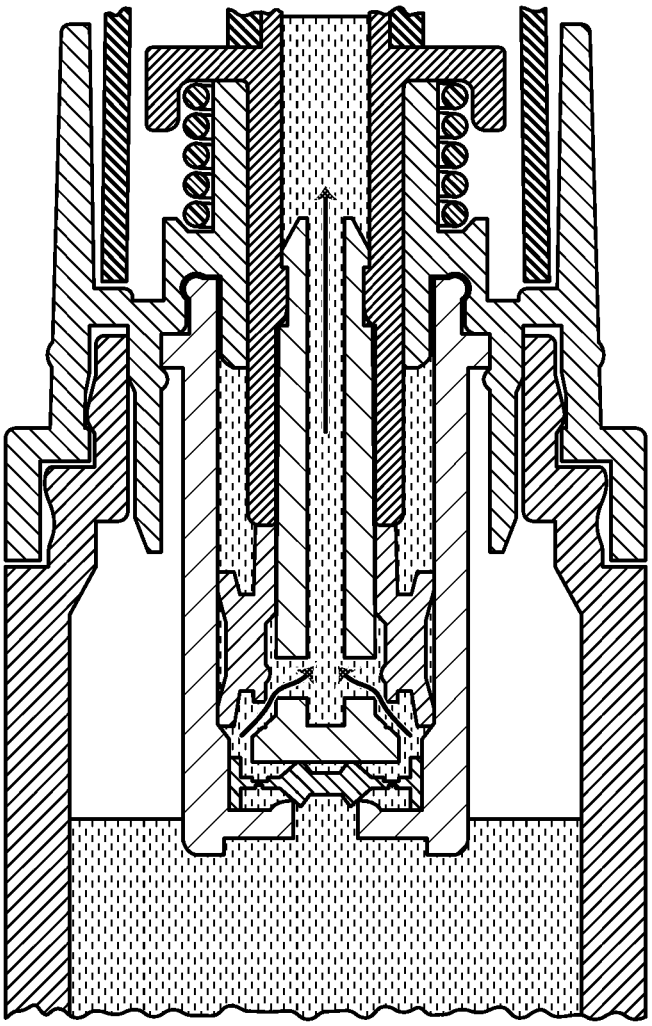
Figure 13D:
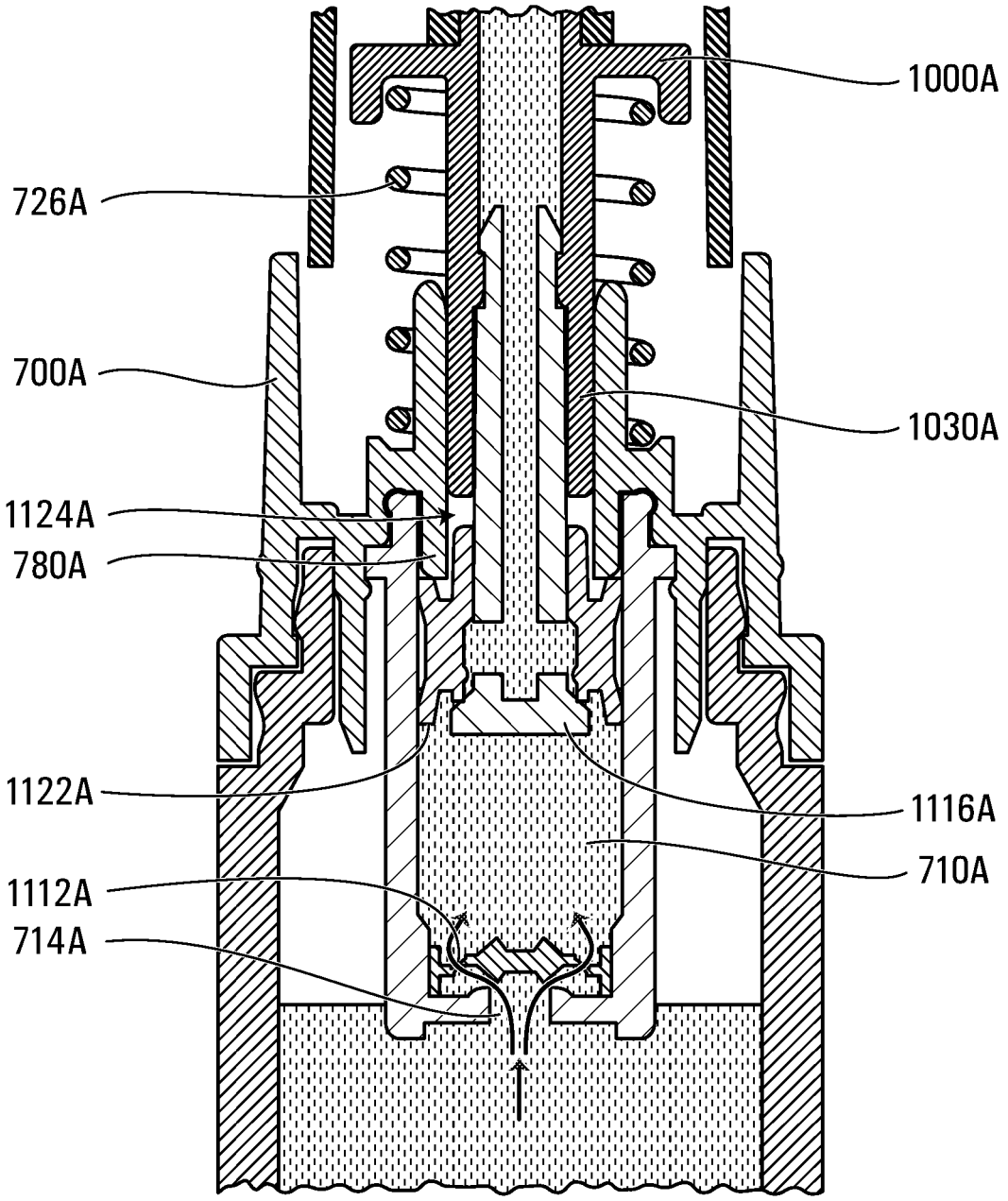
FIG. 13D is a side elevational cross-sectional view of the valve assembly, in accordance with a non-limiting embodiment, at a point along a return trajectory of the dial.

Operation of the valve assembly 1100A is now described with reference to FIGS. 13A-13D. FIG. 13A shows the piston rod 1102A at its highest longitudinal position in the chamber 710A. In this position, the openings 1114A in the piston rod 1102A are sealed by the seal cap 1106A. However, the openings 1114A will be liberated as the piston rod 1102A begins its journey down into the chamber 710A. Specifically, for a first portion of this longitudinal displacement of the piston rod, the seal cap 1106A remains stationary, as there is a gap 1124A between the base 1030A of the stem 1000A and the upper portion 1120A of the seal cap 1106A. Then, as the gap 1124A is closed by downward motion of the base 1030A of the stem 1000A, the base 1030A eventually contacts the upper portion 1120A of the seal cap 1106A, as is shown in FIG. 13B. At this point, fluid is allowed to travel through the openings 1114A and upwards through the center of the piston rod 1102A. The fluid continues to travel upwards through the piston rod 1102A as shown in FIG. 13C until the base 1116A of the piston rod 1102A is stopped by the check valve 1108A at the bottom of the chamber 710A. Meanwhile, it will be noted that the spring 726A has become compressed.

On the return stroke of the piston rod 1102A, the piston rod 1102A rises due to rising of the stem 1030A, which could be caused by user actuation of the dial 420 or by the force of decompression of the spring 726A or both. Fluid is now drawn from the reservoir 18A into the chamber 710A through the orifice 714A and the openings 1112A of the check valve 1108A. The lower portion 1122A of the seal cap 1106A is meanwhile being dragged upwards by the base 1116A of the piston rod 1102A, until the seal cap 1106A hits an abutment 780A formed in the body 700A. At this point, and with reference to FIG. 13D, the seal cap 1106A stops its ascent and the aforementioned gap 1124A is re-formed between the upper portion 1122A of the seal cap 1106A and the base 1030A of the stem 1000A.

Irrespective of the type of valve assembly that is used, the volume of fluid that is dispensed depends on the amount of axial displacement of the piston rod. This could include the amount of axial displacement on the way down, or on the way up, or both, depending on the design of the valve assembly. Returning now to the embodiment that had been described with reference to FIGS. 1A through 10B and 17, the amount of axial displacement of the piston rod 1102 is itself a function of the amount of displacement of the stem 1000, which in turn depends on the extent of angular rotation of the outer shell 800 of the dial 420.

Figure 8B:
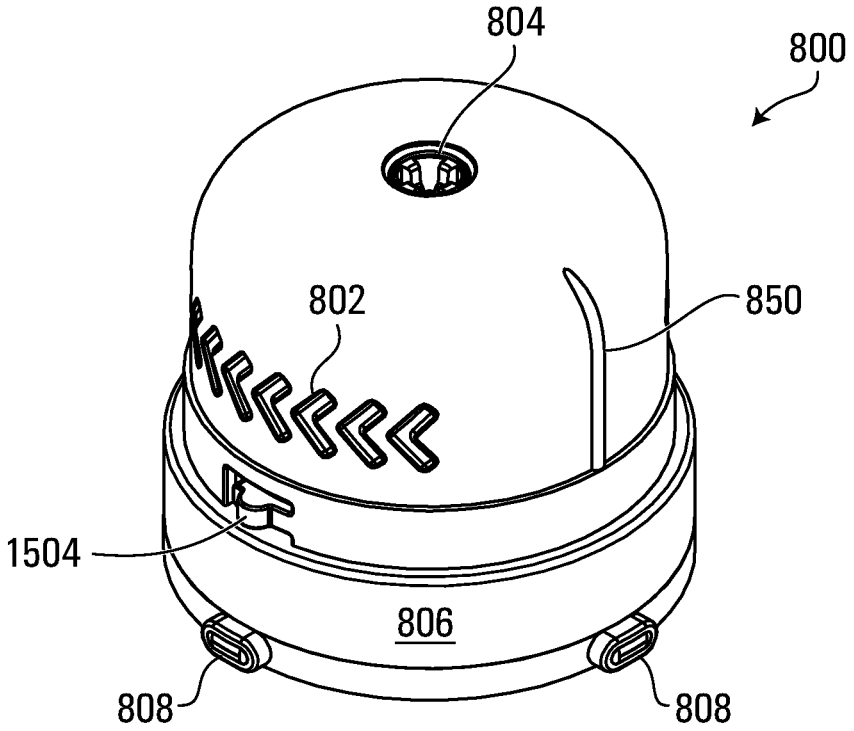

With reference to FIGS. 1A and 8B, to facilitate use of the dispenser 14, the outer shell 800 of the dial 420 may include a marker 850. In two example non-limiting embodiments, the marker 850 may be printed or embossed on the outer surface of the outer shell 800 of the dial 420. The marker 850 is located at a certain point around the periphery of the outer shell 800. Assume that the spring 726 is completely decompressed and that the actuator 400 is at the beginning of a dispensing cycle. This position may be referred to as a "start position" for the dial 420, and an area on the ledge 608 of the shoulder 600 opposite the marker 850 is marked by an indicator 650 referred to as a "start indicator", which may be printed, or debossed, or embossed with information such as "zero", "0", "start", etc., or any other kind of symbol. In some embodiments where rotation of the dial 420 in the opposite direction from the start position may be blocked, the start indicator 650 may be omitted, as the start position of the dial can be easily perceived by the user.

As the outer shell 800 of the dial 420 is turned relative to the shoulder 600, the marker 850 follows a curved path, defining an angular displacement. Pre-determined angular displacements for the marker 850 (referred to as "dosage positions" for the dial 420) are marked on the ledge 608 of the shoulder 600 with respective "dosage indicators" 660A-660C. Each given dosage position corresponds to a dosage that the dispenser 14 is configured to dispense during the time period when the outer shell 800 of the dial 420 is rotated from the start position (i.e., when the marker 850 is aligned with the start indicator 650) to the given dosage position (i.e., when the marker 850 is aligned with one of the indicators 660A-0660C) and back to the start position. Actual dispensing of the fluid may occur only during the first half of the dispensing cycle (i.e., rotation of the dial 420 from the start position to the given dosage position) or only during the second half (from the given dosage position back to the start position) or during both halves, depending on the type of valve assembly that is used, as has been previously described. The dosage indicators 660A-660C may specify (e.g., by virtue of being printed, debossed or embossed with, or including a sticker indicating) the actual dosage that is dispensed. In a non-limiting embodiment, the dial 420 may acquire three dosage positions (which do not include the start position), each corresponding to a different dosage, although there may be more or fewer possible dosage positions in other practical embodiments.

The range of possible dosages that can be dispensed will naturally depend on the capacity of the chamber 710. As such, example dosages could be 0.1 ml, 0.2 ml, 0.25 ml, 0.5 ml, 1 ml, 1.5 ml, 2.0 ml and 5.0 ml, to name a few non-limiting possibilities. It should be appreciated that the dosages corresponding to the various dosage positions of the dial 420 may be independent of one another. Specifically, although it is possible for the second smallest dosage to be an integer multiple of the smallest dosage, this need not be the case. Thus, dosage positions corresponding to dosages of 0.1, ml, 0.25 ml and 0.5 ml may be a feasible and acceptable combination of dosages. Dosage positions that correspond to numerous other dosages and combinations of dosages are of course possible, again with no particular restriction as to whether any of the dosages are multiples of one another. It should be appreciated that in the case dosages X and Y are among the dosages that can be dispensed by the dispenser 14, and where the prescribed dosage for a medicated cream or lotion changes over time between dosage X and dosage Y, this can allow the user to easily change from dosage X to dosage Y by simply rotating the dial 420 to/from the new dosage position corresponding to dosage Y (which will be attained when the marker 850 is aligned with the corresponding dosage indicator). The simplicity with which this can be done on the part of the user may facilitate patient compliance with a time varying dosage regime.

Figure 12A:
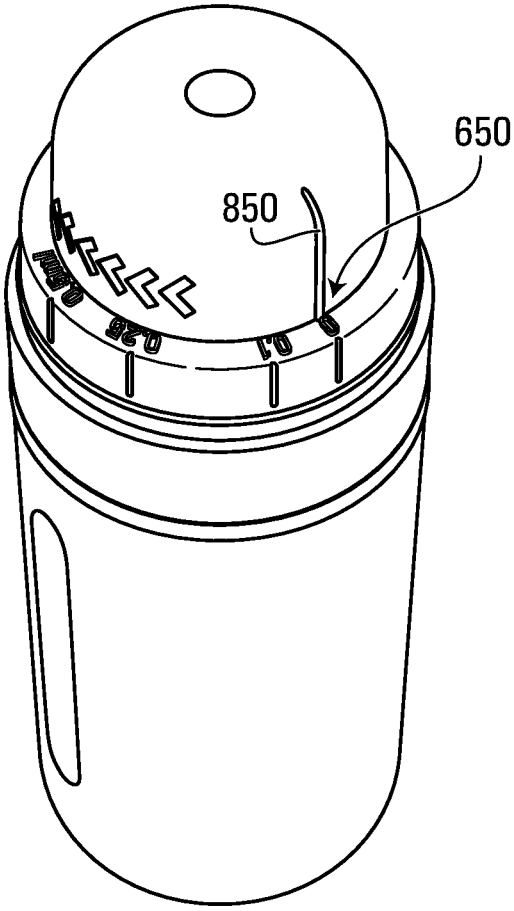
FIGS. 12A to 12E are a sequence of perspective views of the container in accordance with a non-limiting embodiment, showing the dial at different stages of rotation and the dispenser at different stages of dispensing.
Figure 12B:
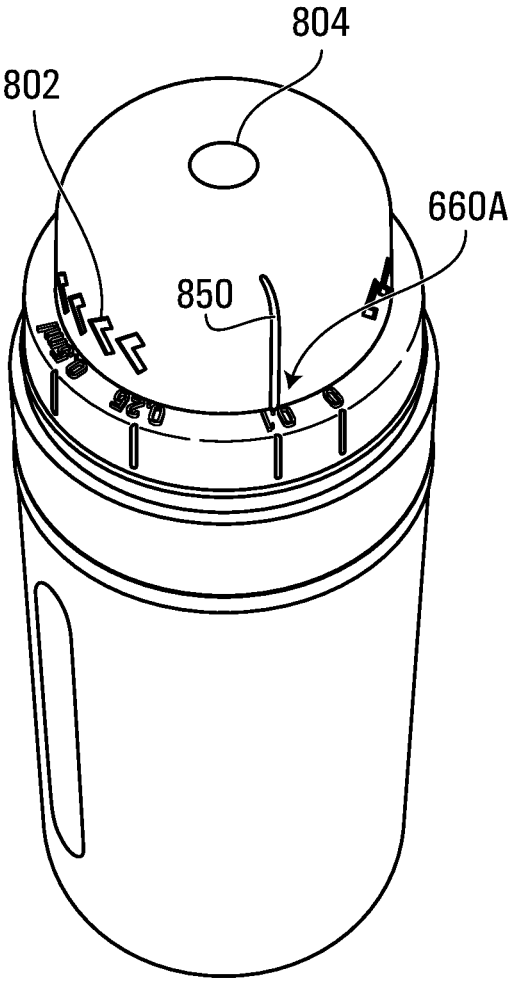
Figure 12C:
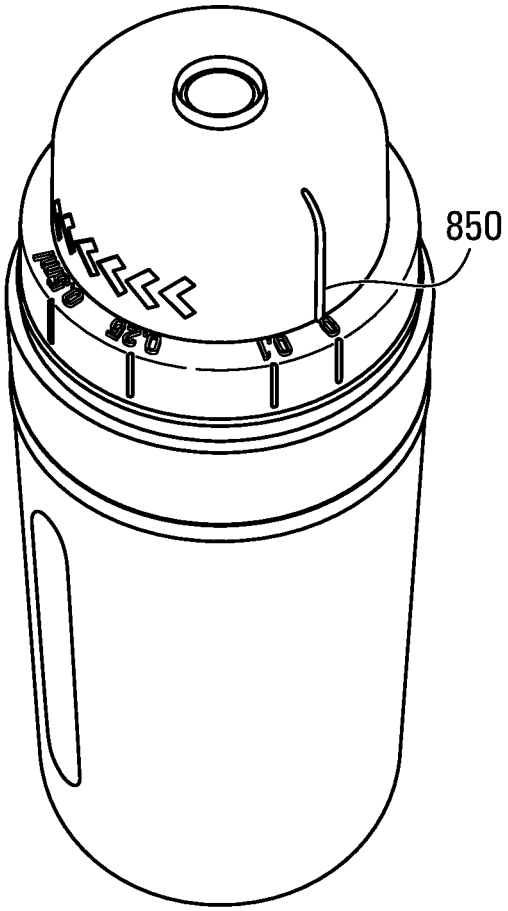
Figure 12D:
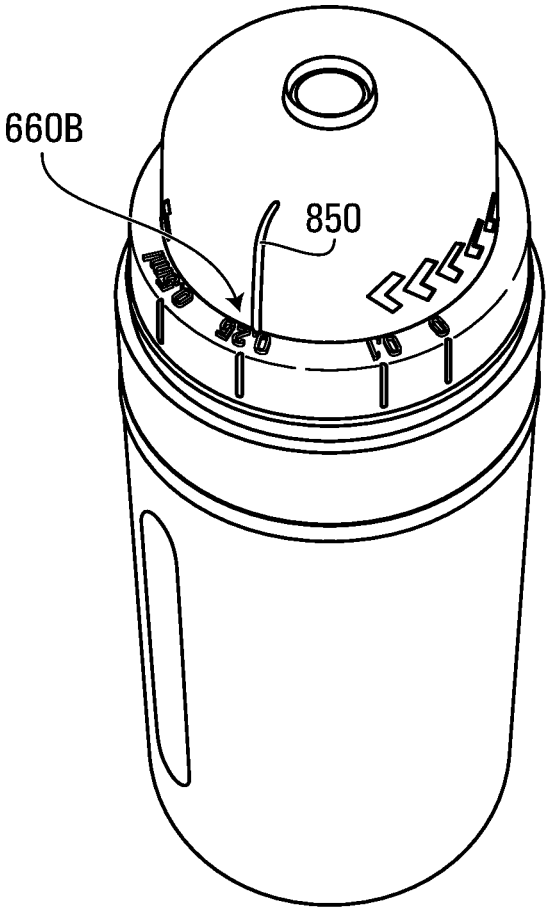
Figure 12E:
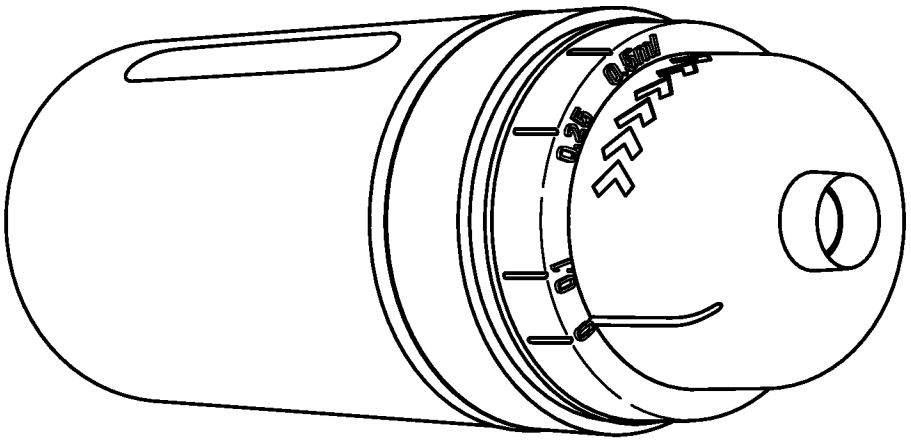

From a user's point of view, and with reference to FIGS. 12A-12E, the user turns the outer shell 800 of the dial 420 in a certain direction from the start position (see FIG. 12A, where the marker 850 is aligned with the start indicator 650), to a selected (or desired) dosage position (see FIG. 12B, where the marker 850 is aligned with dosage indicator 660A), and then back to the start position (see FIG. 12C). Finger grips (e.g., the relief pattern 802) may facilitate gripping of the outer shell 800 of the dial 420 and/or may include a particular pattern which indicates the possible direction of rotation for actuation. Depending on the angular displacement imparted by the user to the dial 420, the selected dosage position may be the first dosage position (which would result in dispensing of the smallest amount of volume of fluid that the dispenser is able to dispense), the last dosage position (which would result in dispensing of the largest amount of volume of fluid that the dispenser is able to dispense) or an intermediate dosage position. In the case of the sequence from FIGS. 12A-12E, the selected dosage position was the first dosage position (whereby the marker 850 is aligned with dosage indicator 660A corresponding to a dosage of 0.1 ml), while in the continuation of this sequence, i.e., FIGS. 12C-12E, the selected dosage position was an intermediate dosage position (whereby the marker 850 is aligned with dosage indicator 660B corresponding to a dosage of 0.25 ml), which leads to a total dispensed volume of 0.35 ml through the egress port 804. In this embodiment, it will be observed that fluid dispensing occurs on the return path from the selected dosage position to the start position, but as mentioned previously, this need not be the case in all embodiments.

It should be appreciated that when the dial 420 is rotated away from the start position towards one of the dosage positions, the spring 726 is compressed. Conversely, when the dial 420 is brought back to the start position, this creates headroom for the compressed spring 726, which expands and applies pressure to the stem 1000 against the inner shell 900 of the dial 420 towards its original axial position as the dial 420 returns to the start position. In some non-limiting embodiments, the spring 726 may be sufficiently strong so as to urge the dial 420 back to its start position without user manipulation of the dial 420. That is to say, merely by the user letting go of the dial 420 after reaching a selected dosage position, the decompression force of the spring 726 will cause the dial 420 to return to the start position. One should also bear in mind that the strength of the spring 726 required to force the dial 420 back to the start position may also be influenced by the configuration of the profile of the connecting surfaces of the stem 1000 and the dial's inner shell 900, as will now be described.

Indeed, to dispense the amount of fluid indicated by a particular dosage indicator, a calibrated design of the stem 1000 and the dial's inner shell 900 is needed. To this end, in order to provide a certain degree of precision and/or accuracy with which predetermined doses of fluid can be dispensed, the contoured ridges 1006 of the stem 1000 are specially profiled, taking into account the predetermined dosage positions of the dial 420, as will now be described, with reference to FIGS. 16A and 16B.

Figure 16A:
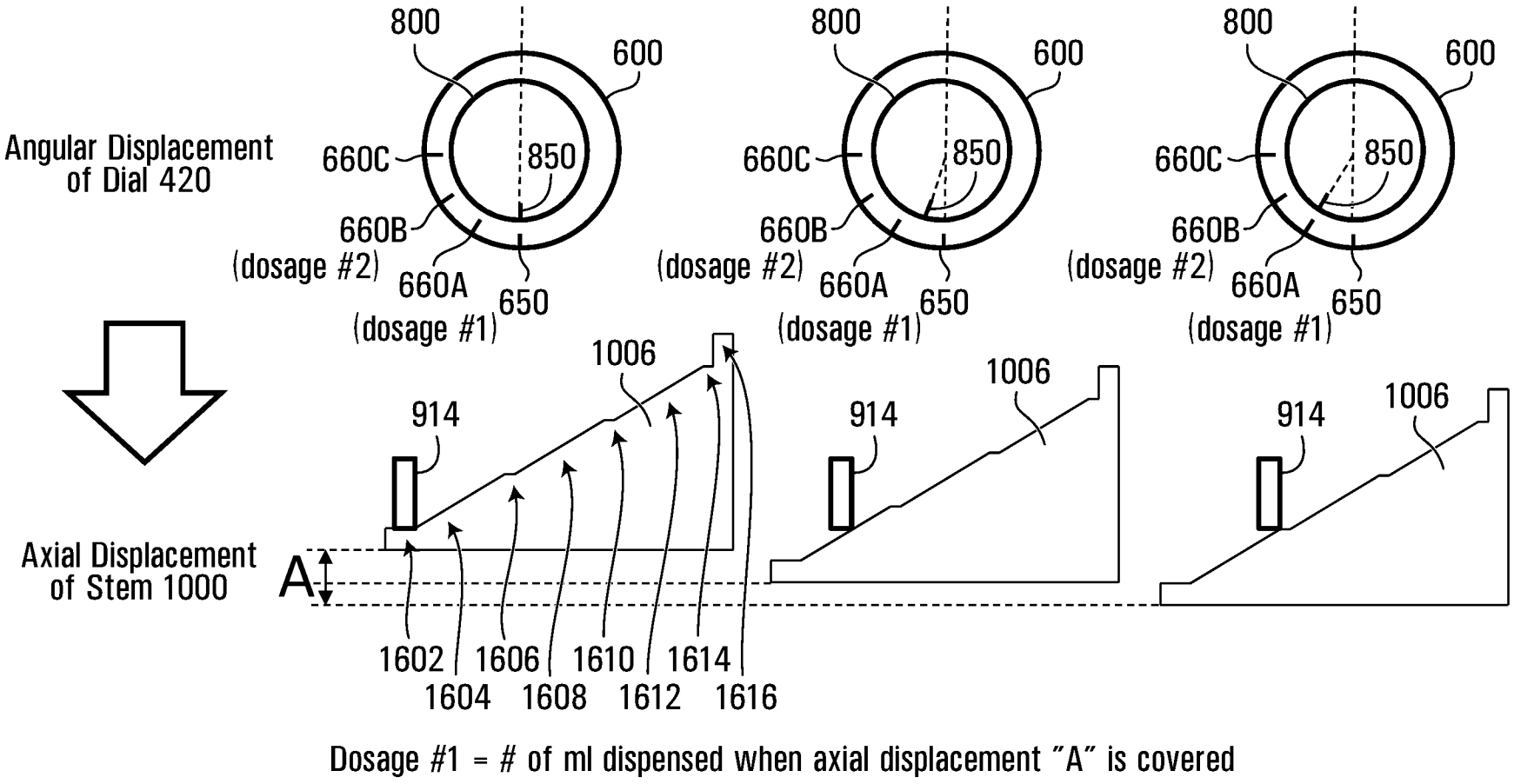
FIGS. 16A and 16B are a sequence of diagrams showing a relationship between rotational motion of the dial relative to the housing and the resultant axial motion of the stem.
Figure 16B:
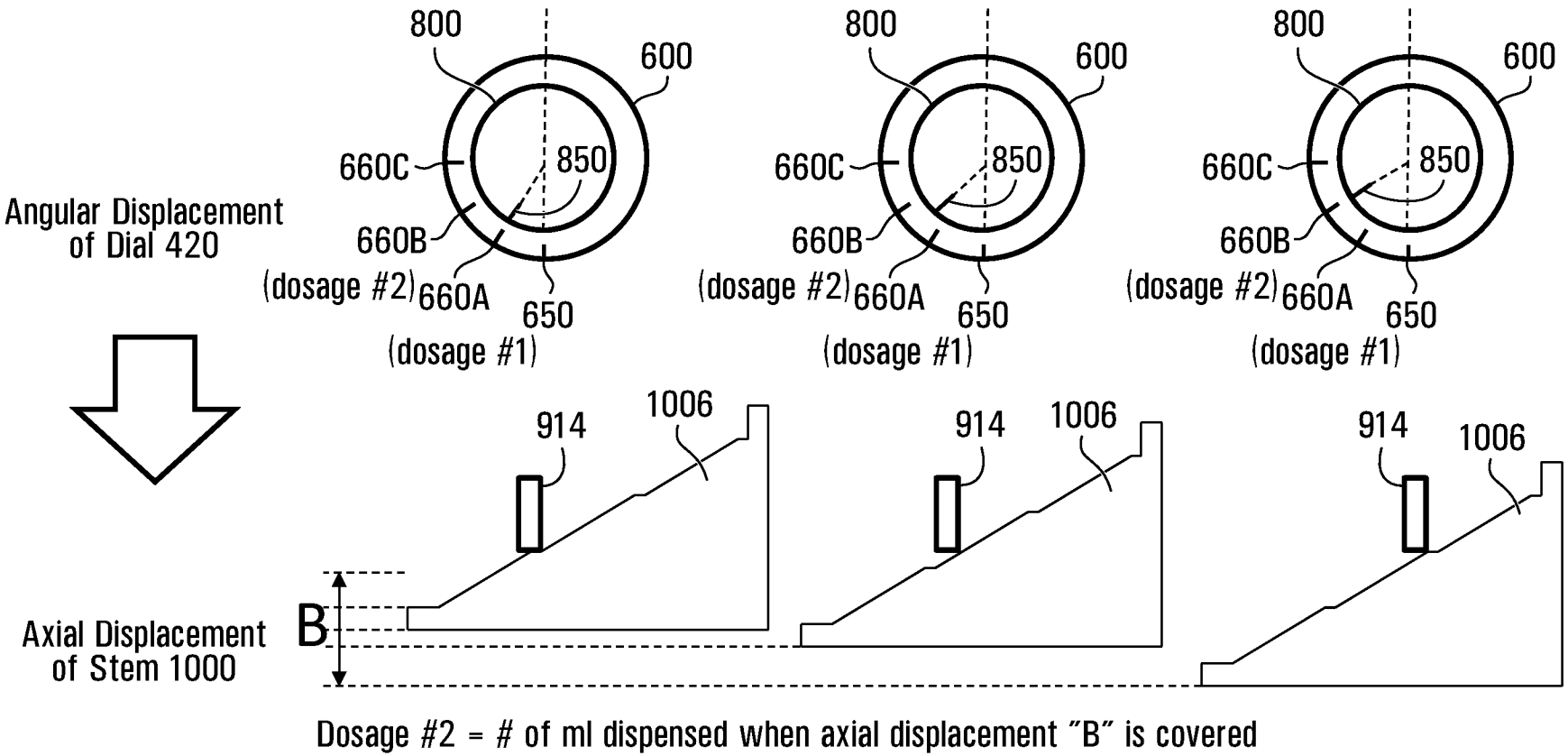

Recalling that the contoured ridges 1006 each have a surface in contact with a surface of a corresponding one of the hanging arms 914, FIG. 16A conceptually relates the changing angular positions of one of the hanging arms 914 to the changing axial positions of the corresponding contoured ridge 1006 in the case where the dial 420 acquires a first dosage position. This is continued in FIG. 16B, which presents the situation in the case where the dial 420 acquires the next dosage position. The diagrams of FIGS. 16A and 16B are in fact curvilinear projections, such that clockwise rotation of the hanging arm 914 is represented as lateral movement towards the right, which is associated with downward movement of the contoured ridge 1006. The upper image in each of FIGS. 16A and 16B illustrates the angular position of the outer shell 800 of the dial 420 and the corresponding relative lateral position of the hanging arm 914 is shown in the lower image. Also shown are the start indicator 650 and the dosage indicators 660A-660C as indicated on the shoulder 600 of the housing 410, as well as the marker 850 on the outer shell 800 of the dial 420.

With reference to FIGS. 16A and 16B, a non-limiting embodiment of a possible profile of one of the contoured ridges 1006 is shown. Changes in axial displacement of the contoured ridge 1006 occur due to a lower extremity of the hanging arm 914 obliquely pushing against the surface of the contoured ridge 1006. It will be observed that the surface of the contoured ridge 1006 varies with the angle of rotation. Specifically, the contoured ridge 1006 presents a surface that has a plurality of sections 1602-1614, including a plurality of segments, in this case alternating plateaus 1602, 1606, 1610, 1614 and inclines 1604, 1608, 1612. Of course, contoured ridges 1006 with shapes other than a combination of plateaus and inclines are possible, including curved shapes, shapes that are not monotonically increasing, etc.

The transitional regions from plateau to incline, and from incline to plateau provide perceptible feedback to the user. In particular, with reference to FIG. 16A, consider the situation where the outer shell 800 of the dial 420 is in the start position and a surface of the hanging arm 914 is in contact with plateau 1602. Now consider that the user applies (clockwise) torque on the dial 420. This forces the hanging arm 914 against incline 1604. Some initial resistance is presented by the contoured ridge but with sufficient torque applied by the user, the initial resistance is overcome and the hanging arm 914 begins to turn, which urges the contoured ridge 1006 downwards. Having overcome the initial resistance, the resistance now presented by the contoured ridge 1006 decreases to a somewhat lower level, although it may be somewhat counterbalanced by a slight increase in resistance provided the spring 726 in response to compression thereof. During this time (while the hanging arm 914 is in moving contact with incline 1604), the contoured ridge 1006 moves downward and presses down on the piston rod 1102 as has been previously described. After a certain angular displacement of the dial 420, the surface of the contoured ridge 1006 transitions to plateau 1606. This will be felt as a sudden falloff in the resistance applied against turning of the dial 420. This is an example of tactile feedback capable of signaling to the user that a dosage position has been reached. If the user is unsure of which dosage position has been reached he or she need simply look at the actuator 400 and observe the alignment of the marker 850 with the corresponding dosage indicator, in this case dosage indicator 660A. The user may continue to apply torque to the outer shell 800 of the dial 420. This will continue to move the hanging arm 914 rotationally but, because it has met plateau 1606, this will not result in additional dispensing. At some point, the hanging arm 914 reaches a point on the surface of the contoured ridge 1006 where incline 1608 begins, and this will be felt by the user as an increase in resistance to turning of the dial 420. Thus, depending on the embodiment, the dosage marker 660A corresponding to the first dosage may be placed at the angular position where the hanging arm 914 first reaches plateau 1606 (as shown in FIGS. 16A and 16B), or it may be placed at a somewhat further angular distance, where a portion of or the entirety of the hanging arm 914 rests on the plateau 1606, or where the hanging arm 914 reaches incline 1608.

Consider now the situation in FIG. 16B, wherein the hanging arm 914 has reached a point on the surface of the contoured ridge 1006 where incline 1608 begins. Incline 1608 has to be overcome by the application of sufficient force to the dial 420 on the part of the user. Again, the hanging lever 914 begins to turn, which urges the contoured ridge 1006 further downwards. After this somewhat higher resistance is overcome, the resistance presented by the contoured ridge 1006 decreases, but may be partially counterbalanced by an increase in resistance from the spring 726, which is becoming increasingly compressed. During this time (while the hanging arm 914 is in moving contact with incline 1608), the contoured ridge 1006 moves downward and presses down on the piston rod 1102 as has been previously described. After a certain additional angular displacement of the dial, 420 corresponding to the second dosage position (i.e., when the marker 850 is aligned with the second dosage indicator 660B), the surface of the contoured ridge 1006 transitions to plateau 1610. This will be perceived as a sudden falloff in the resistance applied against turning of the dial 420. After a slight amount of additional rotation, the hanging arm 914 hits incline 1612, which is perceived as an increase in the resistance to rotation of the dial 420. The decrease in perceived resistance at the beginning of plateau 1610 and/or the perceived increase in resistance at the end of plateau 1610 (i.e., at the beginning of incline 1612) demonstrate non-limiting examples of tactile feedback capable of signaling to the user that a dosage position has been reached. As previously discussed, if the user is unsure of which dosage position has been reached he or she need simply look at the dial 420 and observe the alignment of the marker 850 with the corresponding dosage indicator, in this case dosage indicator 660B.

The same scenario applies with the third and, and in this case, last dosage position for the dial 420. Once this dosage position has been reached, and the hanging arm 914 reaches plateau 1614, the contoured ridge 1006 presents a wall 1616, which inhibits further angular displacement of the hanging arm 914 and blocks further rotation of the dial 420 under normal usage conditions.

Figure 18:
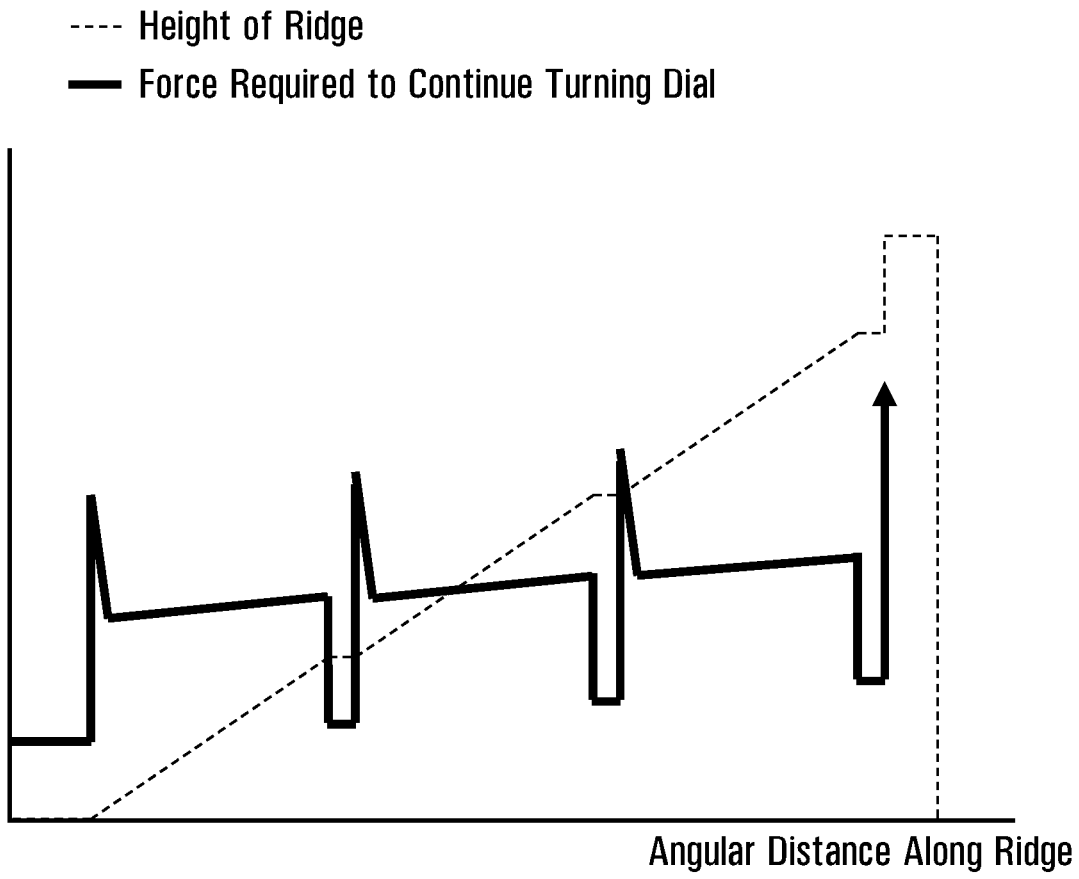
FIG. 18 is a graph of the force needed to turn the dial at different angular positions, in accordance with a non-limiting embodiment.

FIG. 18 shows a graph of the force needed to turn the dial at different points along the surface of the contoured ridge 1006, thereby illustrating one non-limiting example of perceptible dosage feedback that can be provided to a user. This force profile (or, equivalently, resistance profile) is of course non-limiting, as other force profiles may occur in other embodiments.

As can be appreciated from FIGS. 16A and 16B, the contoured ridge 1006 will undergo a displacement "A" caused by rotation of the outer shell 800 of the dial 420 from the start position to the first dosage position, and will undergo a displacement "B" caused by rotation of the outer shell 800 of the dial 420 from the start position to the second dosage position. These displacements can be directly related to the quantity of fluid that is dispensed during the dispensing cycle in each case (where the dispensing cycle includes a return to the start position). This quantity (volume) of fluid depends substantially on (i) the design of the valve assembly 1100 and (ii) the slopes and arc lengths and total number of the inclines as well as location of the plateaus in the profile of the contoured ridges 1006. Assuming that the design of the valve assembly 1100 is fixed and/or cannot be easily changed, the ability to calibrate the dosages of dispensed fluid rests with the design of the number of inclines, their slopes and their arc lengths as well as the location of the plateaus in the profile of the contoured ridges.

For example, while in the illustration, the inclines appear to have the same slope and the same arc lengths, this need not be the case, particularly if the difference in the dosages corresponding to adjacent pairs of dosage positions is not the same from one adjacent pair to another. Moreover, it is possible that depending on the valve assembly design, the relationship between axial displacement of the piston rod 1102 and the quantity of dispensed fluid is not linear. This would imply that the axial displacement needed to dispense a certain amount of fluid would vary depending on how much fluid was already dispensed. As a result, in such an embodiment, the arc length of different inclines would need to be different, even if the differential amount of dispensed fluid is to be the same. Alternatively, the arc length could be kept the same, but the slope could be made to vary.

People skilled in the art will appreciate that there are design trade-offs in terms of the design of the contoured ridges 1006. In one example of a trade-off, the greater the number of dosage positions to be made available, the smaller the difference in resistance at a transition between an incline and a plateau, meaning that the tactile feedback may be less pronounced. This could lead to a lack of dispensing precision and/or accuracy if too many dosage positions are included in the design. Conversely, designing for a high degree of tactile feedback may curtail the number of dosage positions that can be provided. In another example of a trade-off, it is possible to reduce the resistance presented during rotation of the dial 420 between dosage positions by making the slope of the corresponding incline smaller. This would result in a "smoother" feel during dispensing of the fluid. However, this could also require a significant angular distance to be covered before a particular dosage position is reached, which could be inconvenient for a user when the total required rotation of the dial 420 to reach that dosage position exceeds, say, 90 or 180 degrees. Thus, it may be desirable to limit the total angular distance between the start position and the last attainable dosage position to less than 180 degrees or even 90 degrees or less, such as between 45 and 90 degrees, for example. While in this embodiment, it may be desirable to limit the total angular distance between the start position and the last attainable dosage position to less than 180 degrees, the person of skill will appreciate that other practical implementations may limit the total angular distance between the start position and the last attainable dosage position to another degree value, for example but without being limited thereto, less than 270 degrees, less than 225 degrees, less than 200 degrees, and the like. Also, persons skilled in the art will appreciate that the hanging arm 914 may also be designed to have a different shape so that its interaction with the surface of the contoured ridge 1006 enhances the tactile feedback felt when the dial 420 reaches certain angular distances relative to the start position.

The above described embodiments have shown one example of providing tactile dosage feedback by designing the contacting surfaces of the stem 1000 and the inner shell 900 of the dial 420 to exhibit steps in the resistance against rotation of the dial 420, thereby alerting a user as to when a particular dosage position has been reached. In other embodiments, tactile feedback may be provided in different ways. For example, one may inverse the positions of the contoured edge and the hanging arm, i.e., the contoured edge may appear on the dial 420 and the hanging arm could be an erect arm that emerges from the stem 1000. In other embodiments, both the contoured edge and the hanging arm may be profiled. Still other ways of converting rotational motion of the dial into translational motion of a stem and, ultimately, the piston rod, would be apparent to those of skill in the art.

It should be appreciated that in other embodiments, a different form of tactile feedback could be provided.

In still other embodiments, various segments of the surface of the contoured ridge 1006 may include small inclined teeth or nodules, such as at the beginning of—or in lieu of—plateaus 1606, 1610, 1614 that cooperate with the hanging arms 914 in order to provide not only a greater resistance differential immediately before and after a given tooth or nodule is traversed, but also may provide auditory feedback that a dosage position has been reached. Audible feedback may include a snap or click that is caused because of the hanging arm 914 being put under pressure from the inclined tooth/nodule of a particular segment and then such pressure being released as the tooth/nodule is forcibly traversed.

Figure 6A:
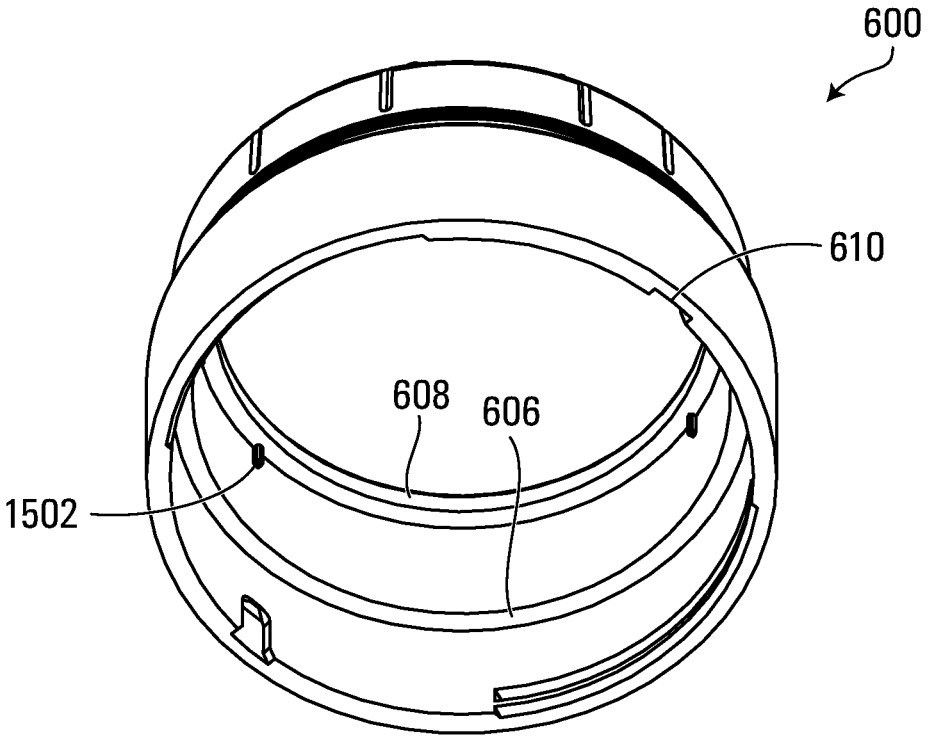
FIGS. 6A and 6B are bottom and top perspective views, respective, of the shoulder of the housing of the actuator, in accordance with a non-limiting embodiment.
Figure 6B:
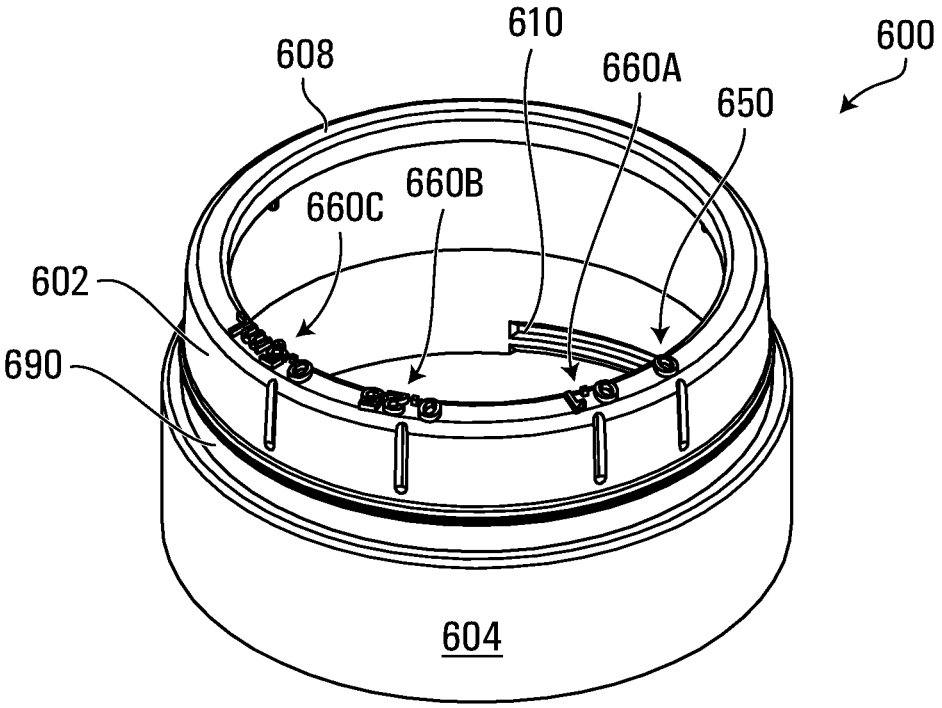
Figure 15:
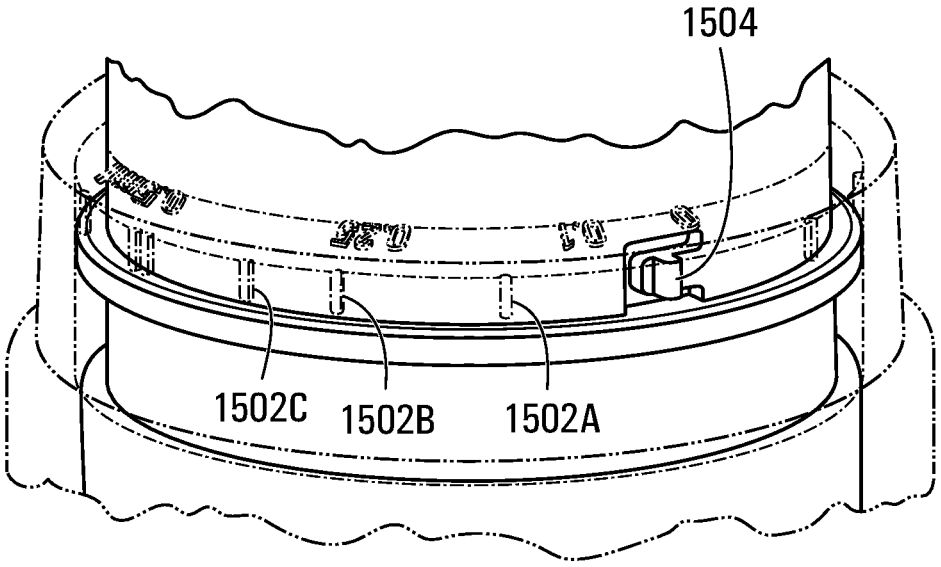
FIG. 15 is a partial perspective cutaway view of the shoulder of the housing and of the outer shell of the dial, in accordance with a non-limiting embodiment, showing complementary parts that participate in snap action to provide audible feedback.

The use of auditory feedback may also be incorporated as a separate feature, to be used in addition to or instead of the tactile feedback (such as would be obtained from the contoured ridges 1006 described earlier). In a non-limiting embodiment, auditory feedback may be provided by snap action. As illustrated in FIGS. 6A, 8B and 15, complementary elements are provided on the outer shell 800 of the dial 420 and on the inner surface of the shoulder 600. In this embodiment, the outer shell includes a tongue 1504 and the shoulder 600 optionally includes ribs 1502, 1502A-C. The ribs 1502A-C are spaced apart angularly by the same angular distance as the dosage indicators 660A-C. The ribs 1502A-C and the tongue 1504 are designed so that they are forced into contact with one another when the user rotates the dial 420 and to snap away from each other as a dosage position is reached. It is envisaged that a number of clicks other than 1 may be provided for a particular dosage position.

In the case of auditory feedback, one may choose to design the ribs 1502A-C and the tongue 1504 so that the audible signal emitted by the snap action differs from one dosage position to another, e.g., by making the dosage positions corresponding to higher dosages result in a different (e.g., higher) pitched sound, etc.

Figure 14:
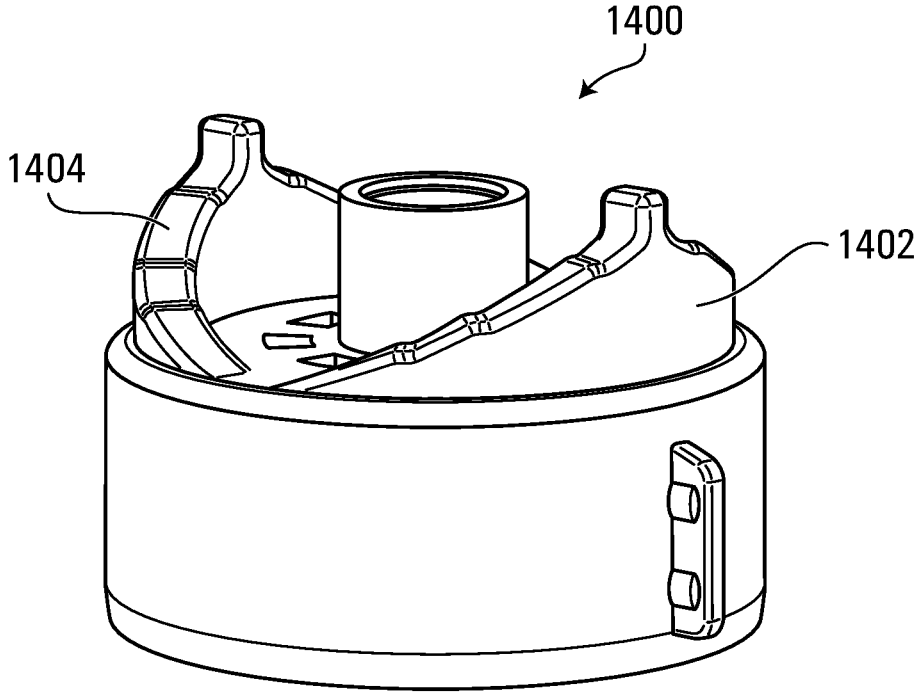
FIG. 14 is a perspective view of the stem of the actuator, in accordance with a non-limiting embodiment, showing a surface profile that permits the dial of the actuator to be rotated both clockwise and counter-clockwise relative to the start position.

The above description has pertained to embodiments where the dosage positions are all located to one side of the start position, namely if the dial is to be turned clockwise to reach a first dosage position from the start position, then the dial is also to be turned clockwise to reach the second dosage position from the start position. This is due to the configuration of the contoured ridges 1006, which can be seen in FIG. 10B to present an abutment 1038 that guards against turning of the hanging arm 914 in the opposite (in this case counter-clockwise) direction from the start position. However, this need not be the case in all embodiments. For example, FIG. 14 shows an embodiment of the stem 1400 in which two contoured ridges 1402, 1404 are provided that allow rotation of the hanging arm 914 (caused by rotation of the outer shell 800 of the dial 420) in both the clockwise and counter-clockwise direction from the start position. In other words, an incline is accessible from the start position, irrespective of the direction of rotation. As such, turning the dial in either direction from the start position starts a dispensing cycle, keeping in mind that depending on the embodiment, actual dispensing of fluid may occur during either or both halves of such dispensing cycle. This type of implementation could allow more flexibility in terms of the number or gradation of dosages of fluid to be dispensed, or may allow greater convenience, depending on whether a user may be more comfortable with one direction of rotation versus another.

Figure 19:
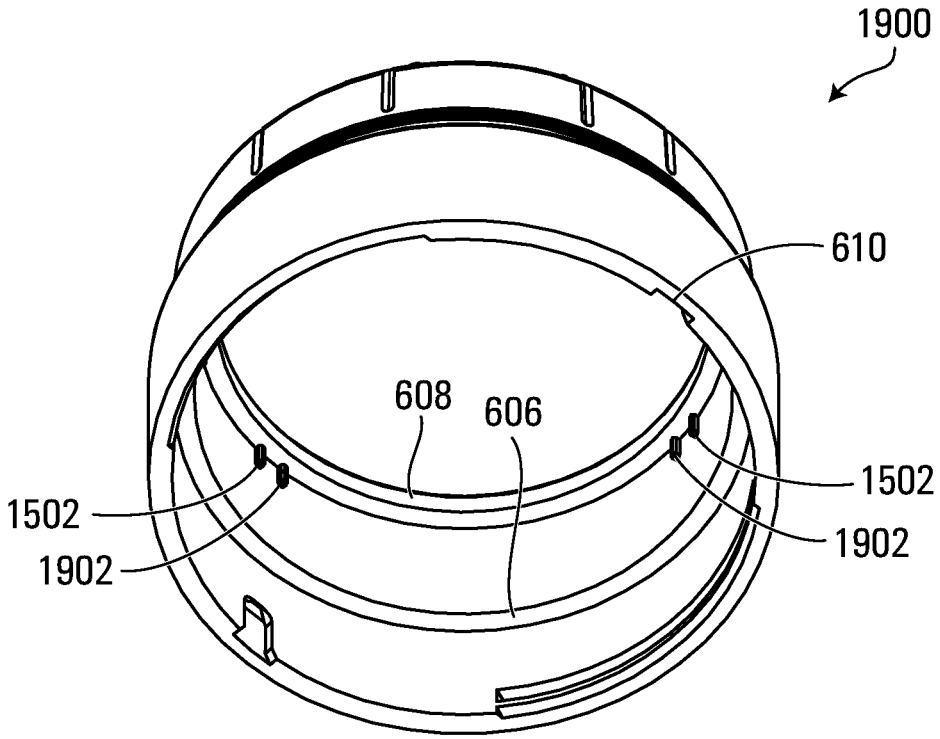
FIG. 19 is a bottom perspective view of the shoulder of the housing of the actuator, in accordance with another non-limiting embodiment.
Figure 20:
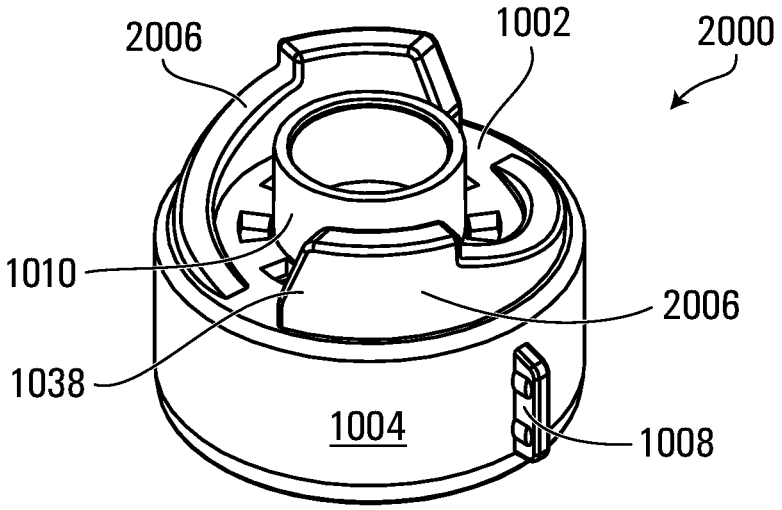
FIG. 20 is a top perspective view of the stem of the actuator, in accordance with another non-limiting embodiment.
Figure 21:
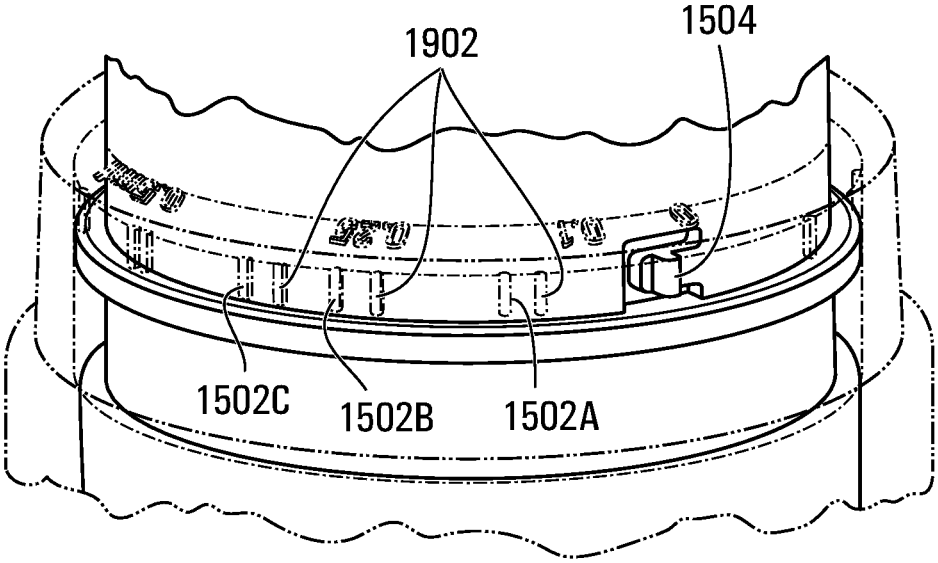
FIG. 21 is a partial perspective cutaway view of the shoulder of the housing and of the outer shell of the dial, in accordance with another non-limiting embodiment.

With reference to FIG. 20, a further non-limiting embodiment of a possible profile of a contoured ridge is shown. The contoured ridge may be one of a plurality of contoured ridges 2006 similar to the contoured ridges 1006 in FIG. 10B except that there are no intermediate plateaus, i.e., the contoured ridges 2006 may present a steady incline. As a result, the resistance to turning the dial that is provided by the interface between the hanging arms 914 and the contoured ridges 2006 may be continuous, linear or even constant, but in this embodiment does not undergo sudden drops or increases. As such, there may be little or no tactile or audible feedback provided by the contoured ridges 2006 as the dial 420 is turned. Rather, in this embodiment, and with additional reference to FIGS. 19 and 21, tactile (and possibly also audible) feedback during rotation of the dial is provided by ribs 1502, 1902 provided on the shoulder 1900 (which is similar to the shoulder 600).

In particular, ribs 1502 provide first tactile feedback when a certain dosage is about to be reached and ribs 1902 provide second tactile feedback when the certain dosage has been reached. The first and/or second tactile feedback may be accompanied by audible feedback too. The first tactile feedback may be offer a different resistance to turning the dial 420 than the second tactile feedback. This may be due to the shape or size of ribs 1502 being different form the shape or size of ribs 1902. Ribs 1502 may thus function to alert the user to the fact that a certain dosage is about to be reached, while ribs 1902 may function to alert the user to the fact that this dosage has been reached. In other embodiments, only ribs 1902 may be provided.

Finally, when it comes to the final dosage position, and therefore the last dosage position for the dial 420, the contoured ridge 2006 presents the aforementioned wall 1616, which inhibits further angular displacement of the hanging arm 914 and blocks further rotation of the dial 420 under normal usage conditions.

Figure 22:
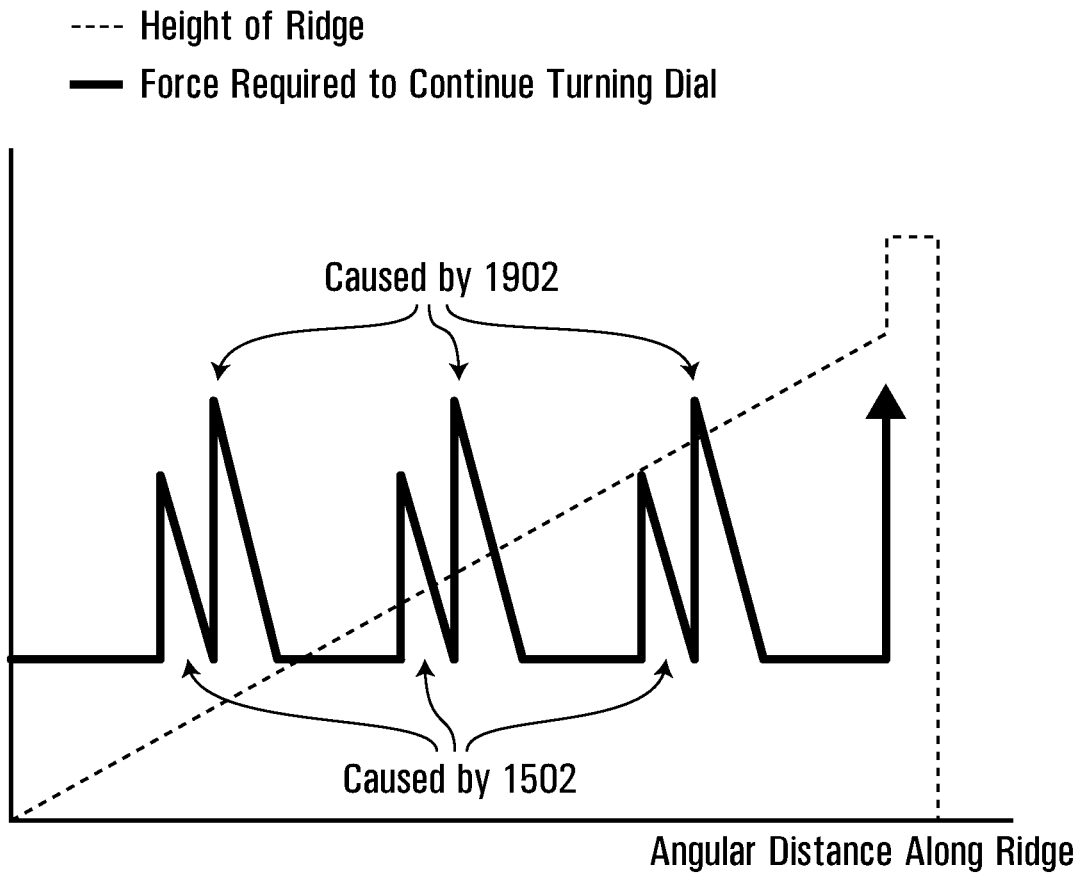
FIG. 22 is a graph of the force needed to turn the dial at different angular positions, in accordance with another non-limiting embodiment.

FIG. 22 shows a graph of the rotational force that a user would need to exert on the dial 420 in order to turn it, for different points along the surface of the contoured ridge 2006, thereby illustrating a further non-limiting example of perceptible dosage feedback that can be provided to a user. It is seen that each of the first peak is caused by one of the ribs 1502 just prior to a certain dosage position being reached, while a corresponding one of the second peaks is caused by the corresponding one of the ribs 1902 once the certain dosage position has been reached and the correct dosage of fluid has been dispensed. In this embodiment, the second peaks have a greater magnitude than the first peaks, but this could be designed to be the contrary. This force profile (or, equivalently, resistance profile) is again to be taken as non-limiting, as other force profiles may occur in other embodiments.

Version 2

Figure 23:
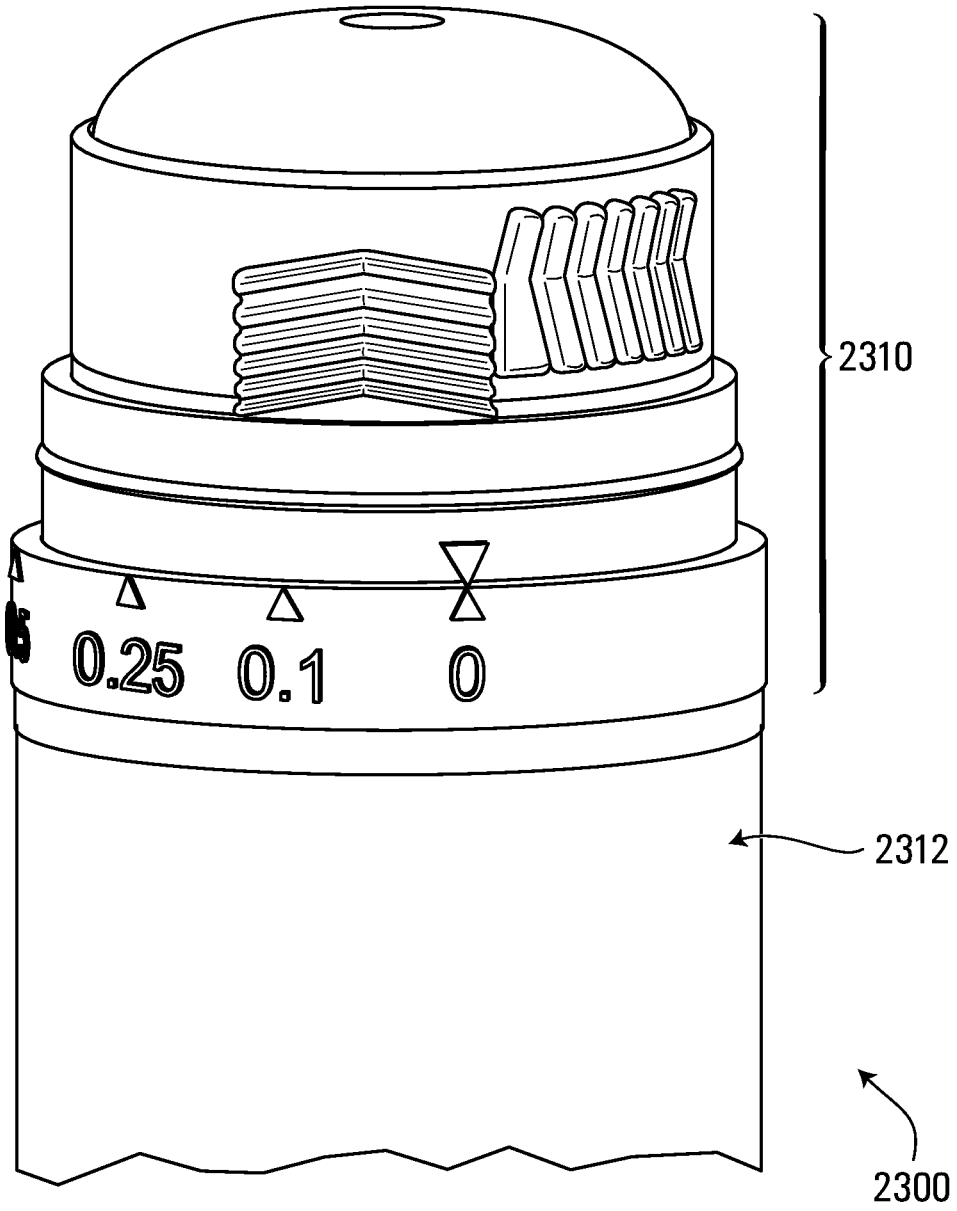
FIG. 23 is a partial side elevational view of a dispensing container including a dispenser in accordance with a non-limiting embodiment.
Figure 24:
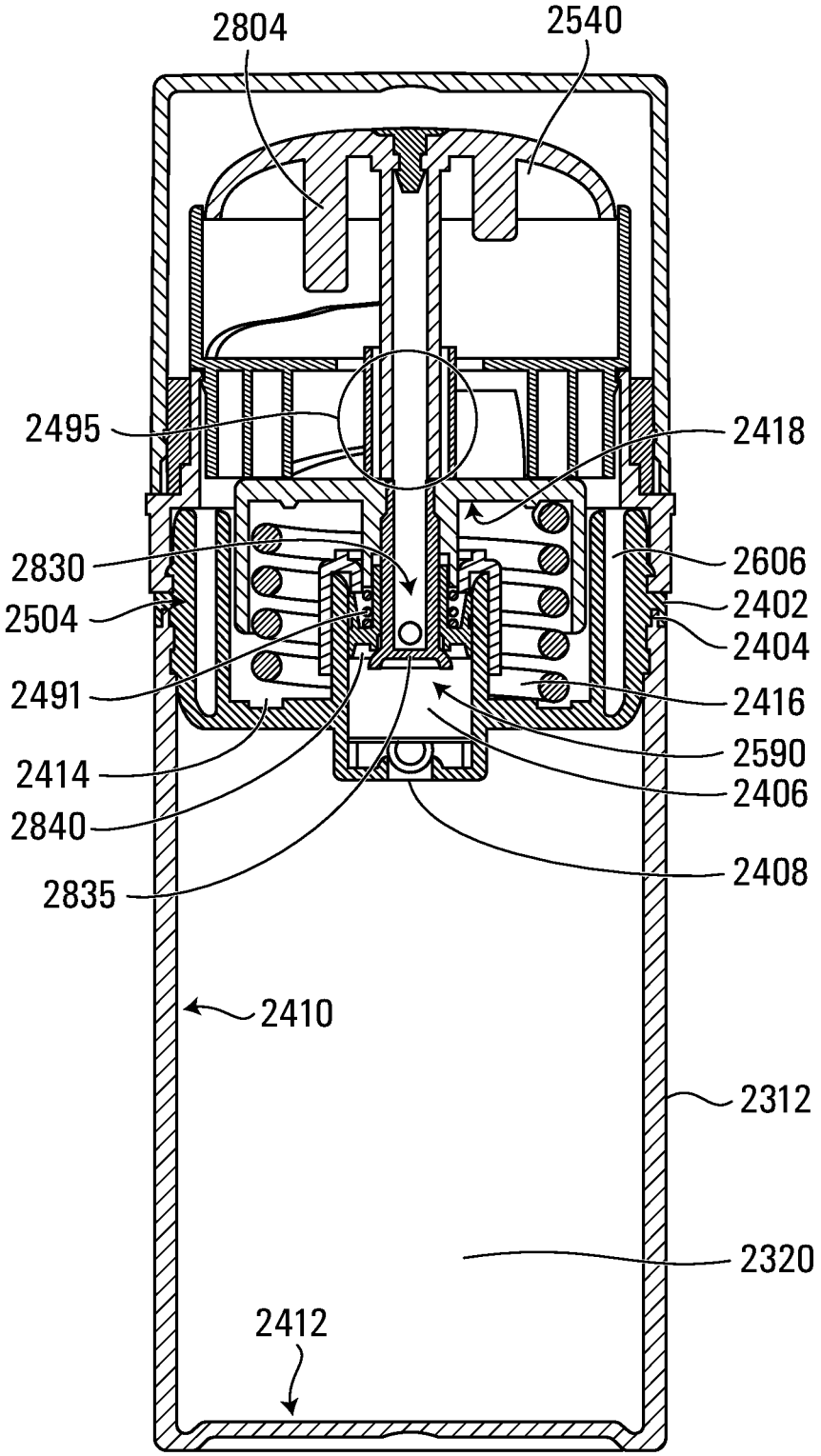
FIG. 24 is a cross-sectional view of a dispensing container including a dispenser, in accordance with a non-limiting embodiment.

With reference now to FIGS. 23 and 24, there is shown a dispensing container 2300 in accordance with another non-limiting embodiment. The dispensing container 2300 may be a bottle or a jar, and comprises a casing 2312 to which is mounted a dispenser 2310 for dispensing fluid contained in a reservoir 2320. The fluid contained in the reservoir 2320 may be a cream, ointment, lotion, emulsion, gel or any other topical formulation or other fluid. The reservoir 2320 may be movable within an inner wall or a bag lining of the casing 2312. In use, the reservoir 2320 migrates upwards towards the dispenser 2310 as the volume of fluid it contains decreases. In some embodiments, the container 2300 may further include a bottom end (not shown). The bottom end may include one or more vents to equalize a pressure differential caused by displacement of a base of the reservoir 2320 towards the dispenser as the volume of fluid held in the reservoir 2320 decreases during use. In other embodiments, the bottom end of the container 2300 may be omitted, rendering the casing a bottomless casing.

Figure 32:
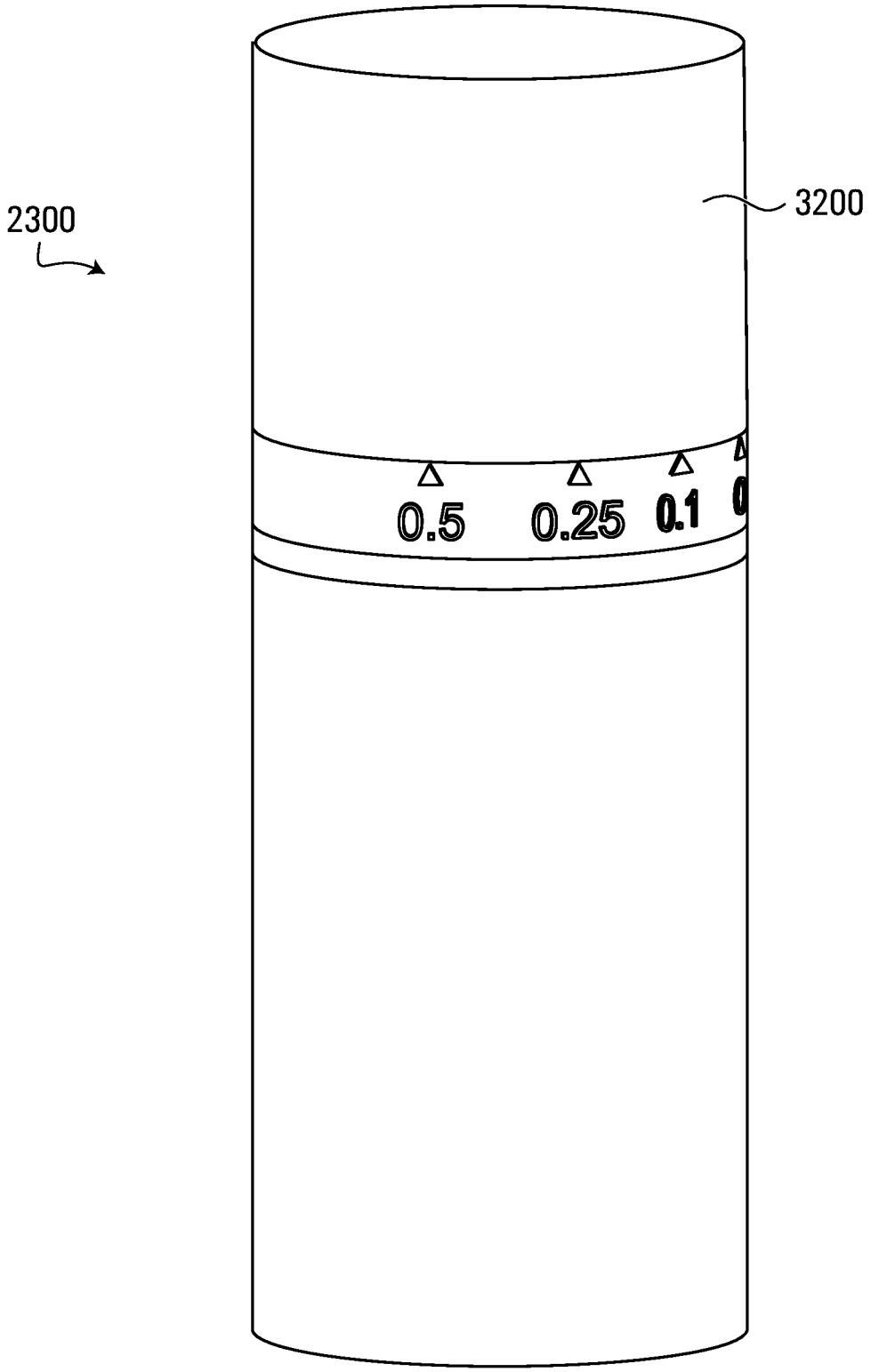
FIG. 32 is a perspective view of a dispensing container that is capped, in accordance with a non-limiting embodiment in which dosage indicators are visible when the dispensing container is capped.

The container 2300 may be generally in the form of a cylinder with a longitudinal axis and two ends, such that the dispenser 2310 is located at one longitudinal end of the container 2300. However, other shapes and configurations are possible. The container 2300 may be made of a plastic or any other suitable material. The container 2300 may be see-through or opaque, and may include one or more fill windows. By way of non-limiting example, certain components of the container 10 may be moulded or 3D-printed. The dispenser 2310 is modular and can be used with casings (similar to casings 12A-12F in FIG. 3) capable of holding different volumes, but having the same size mouth. In some embodiments, a cap 3200 may optionally be disposed atop the dispenser 2310 for purposes of concealment or protection (see FIG. 32).

Figure 25:
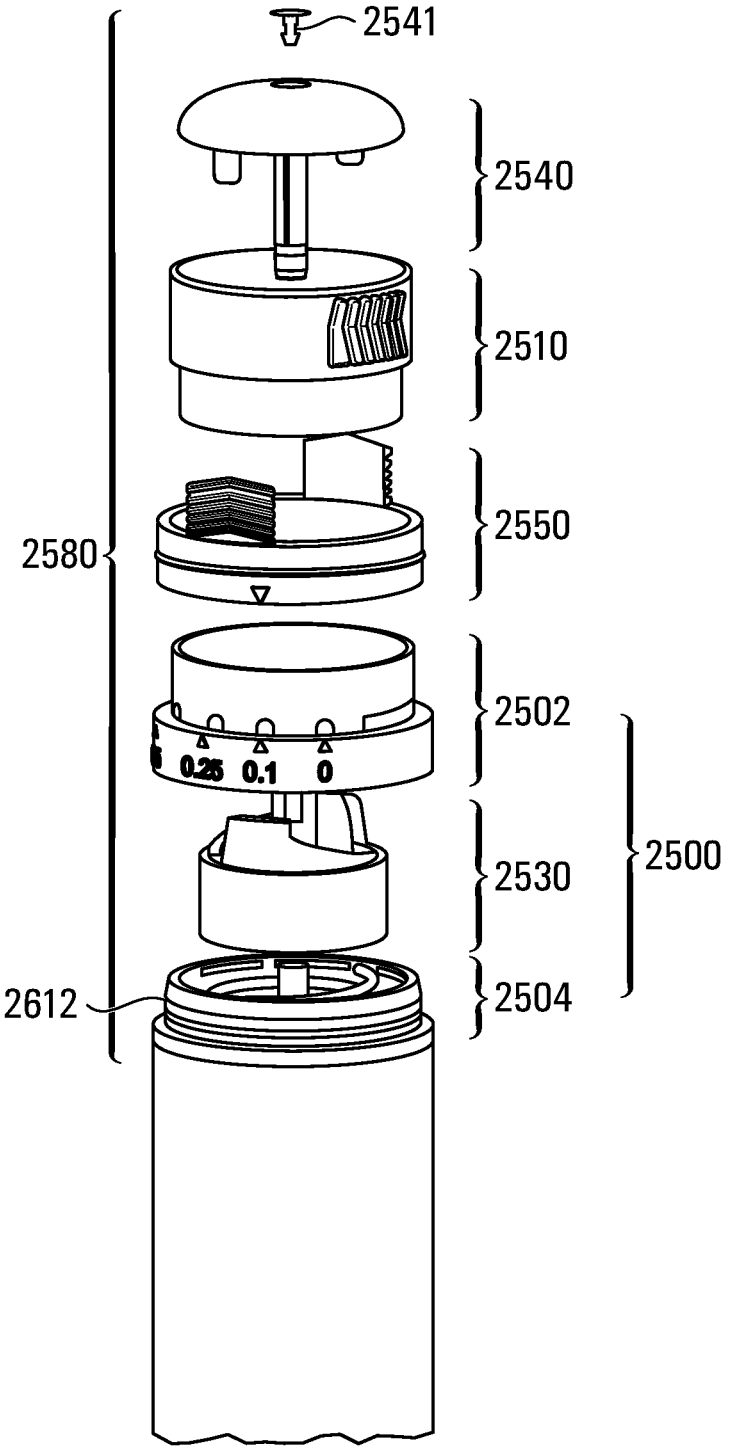
FIG. 25 is an exploded perspective view of various components of the dispenser, in accordance with a non-limiting embodiment.

With additional reference to FIG. 25, the dispensing container 2300 is shown in exploded view. It will be appreciated that once assembled onto the casing 2312, the dispenser 2310 may create a substantially hermetic seal, which in specific implementations, may advantageously minimize tampering, contamination and oxidation of the fluid contained therein.

The dispenser 2310 comprises an actuator 2580 (whose components are seen in FIG. 25 in exploded view) and a valve assembly 2590 (an internal component seen in FIG. 24). In the present non-limiting embodiment, the actuator 2580 includes a housing 2500 attachable to the casing 2312, a rotatable dial 2510 mounted to the housing 2500 and a stem 2530 in contact with both the dial 2510 and the housing 2500. The housing 2500 includes a shoulder 2502 and a body 2504, with the body 2504 being fixed to the casing 2312. Also provided is a tip 2540 and a dosage selector 2550. Finally, a plug 2541 may be provided in some embodiments. Certain ones of the aforementioned components will now be described in the context of a non-limiting embodiment.

With reference to FIG. 24, the body 2504 includes an annular flange 2402 around its periphery, conceptually dividing the body 2504 into a top ring and a bottom ring. The flange 2402 is recessed therebeneath to accommodate a thinned outer wall 2404 at the mouth of the casing 2312. The flange 2402 is designed to have an outer diameter that corresponds to the outer diameter of the casing 2312, so that an exterior of the body 2504 (i.e., the outer surface of the flange 2402) is flush with the exterior of the casing 2312 when the body 2504 is mounted thereto. In order to secure the body 2504 to the casing 2312, the body 2504 is urged downwards onto the casing 2312. A dimple and projection arrangement may facilitate snapping of the body 2504 to the casing 2312.

With continued reference to FIG. 24, towards an interior of the body 2504, there is provided a cylindrical chamber 2406 that accommodates the valve assembly 2590. The chamber 2406 is connected to the reservoir 2320 via an orifice 2408 in the body 2504. The reservoir 2320 is defined by a cylindrical inner wall 2410 of the casing 2312 and a base 2412. In use, the reservoir 2320 normally contains fluid to be dispensed by the dispenser.

The cylindrical chamber 2406 is surrounded by a moat 2414 which is itself surrounded by a thin cylindrical wall comprising axial slots (not shown, similar to axial slots 724 in FIG. 7B). The moat 2414 accommodates a spring 2416 which can be compressed by downwards axial motion of a stem undersurface 2418.

Figure 26:
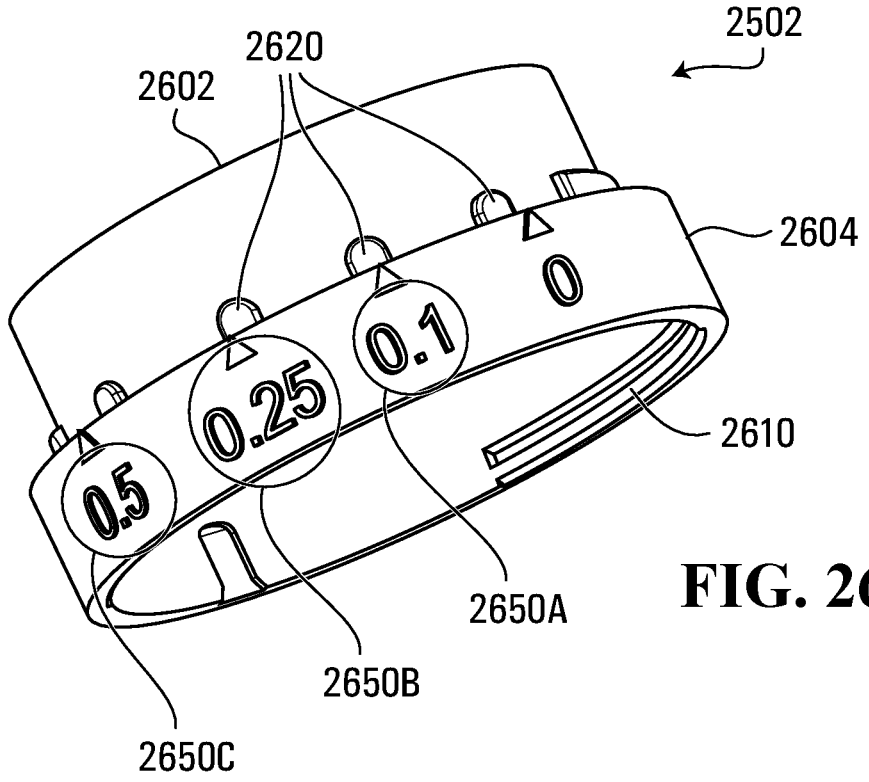
FIG. 26 is a bottom perspective view of a shoulder forming part of the actuator of FIG. 25.

The shoulder 2502 snaps to the body 2504 when assembly of the dispenser 2310 is complete. With additional reference to FIG. 26, the shoulder 2502 generally includes an upper ring 2602 that sits on top of a lower ring 2604, the lower ring 2604 having an outer diameter larger than the outer diameter of the upper ring 2602 and having an inner diameter larger than the inner diameter of the upper ring 2602, thus forming an annular lip on the inside of the shoulder 2502. The upper ring 2602 includes a radially inwardly facing ledge, on which certain protrusions 2620 may be provided at certain angular distances and associated with a plurality of "blocking positions" of the dosage selector 2550. Each blocking position is associated with information such as a dosage, which may be printed, embossed or debossed on the shoulder 2502, e.g., on an outward facing surface of the lower ring 2604.

The lower ring 2604 of the shoulder 2502 may include a plurality of recesses or dimples 2610 while the top ring of the body 2504 may include complementary protrusions 2612 (see FIG. 25) that are configured to snap into these dimples/recesses 2610 when the shoulder 2502 and the body 2504 are urged together. The size of the outer diameter of the lower ring 2604 corresponds to the size of the outer diameter of the casing 2312 and also to the outer diameter of the flange 2402 of the body 2504. In this way, when the shoulder 2502 is mated to the body 2504 and with the cap placed thereon, the resulting dispensing container 2300 (including the casing 2312, the dispenser 2310 and the cap) presents a smooth and uniform outer surface.

For purposes of assembly of the dispenser 2310, the shoulder 2502 and the body 2504 are mated to another (i.e., the dimples/recesses 2610 of the lower ring 2604 of the shoulder 2502 engage the protrusions 2612 of the top ring of the body 2504), however this is done only once the stem 2530, the valve assembly 2590, the dosage selector 2550 and the dial 2510 are set in place.

Figure 28:
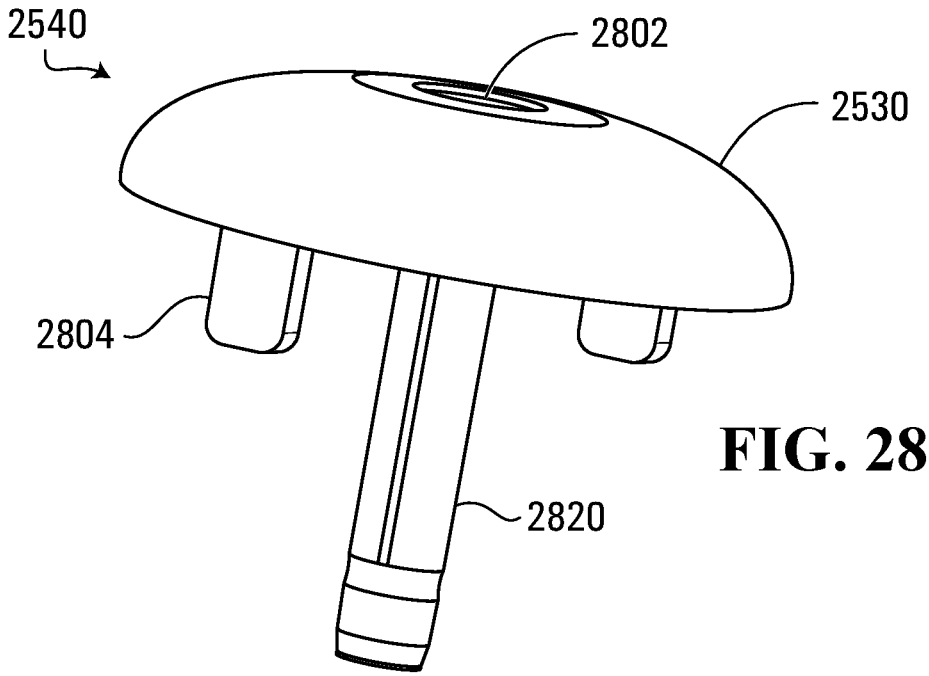
FIG. 28 is a perspective view of a tip forming part of the dispenser of FIG. 25.

With reference to FIG. 28, the tip 2540 includes a conduit 2820. At one end of the conduit 2820 is a piston rod 2830 (see FIG. 24) and at the other end of the conduit 2820 is at least one egress port 2802 through which fluid exits the dispenser 2310. The shape of the egress port 2802 is not particularly limiting, and may be in the form of a ring, one or more holes, one or more slits, etc. Also, while in the illustrated embodiment, the egress port 2802 is centered radially, this need not be the case in all embodiments. The tip 2540 further includes at least one underhanging projection 2804, whose significance will be explained later on in greater detail.

With additional reference to FIG. 25, the plug 2541 may remain affixed to the dispenser 2310 during normal use. If the plug 2541 is used, it may serve two purposes, one being to disperse the contents (e.g., cream, ointment, gel, etc.) in an annular pattern and the second being to seal the contents in the dispenser from the outside environment. However, the plug 2541 does not necessarily provide a hermetic seal.

Figure 27A:
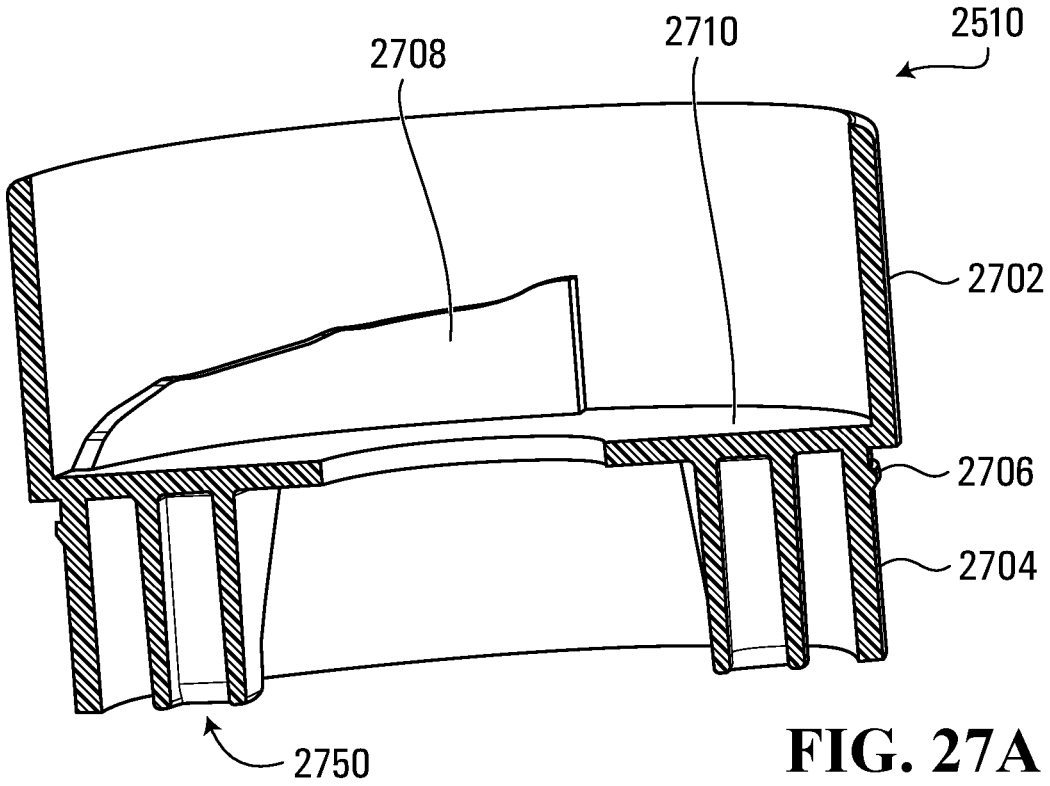
FIGS. 27A and 27B are a cross-sectional perspective view and a top perspective view, respectively, of a dial forming part of the actuator of FIG. 25.
Figure 27B:
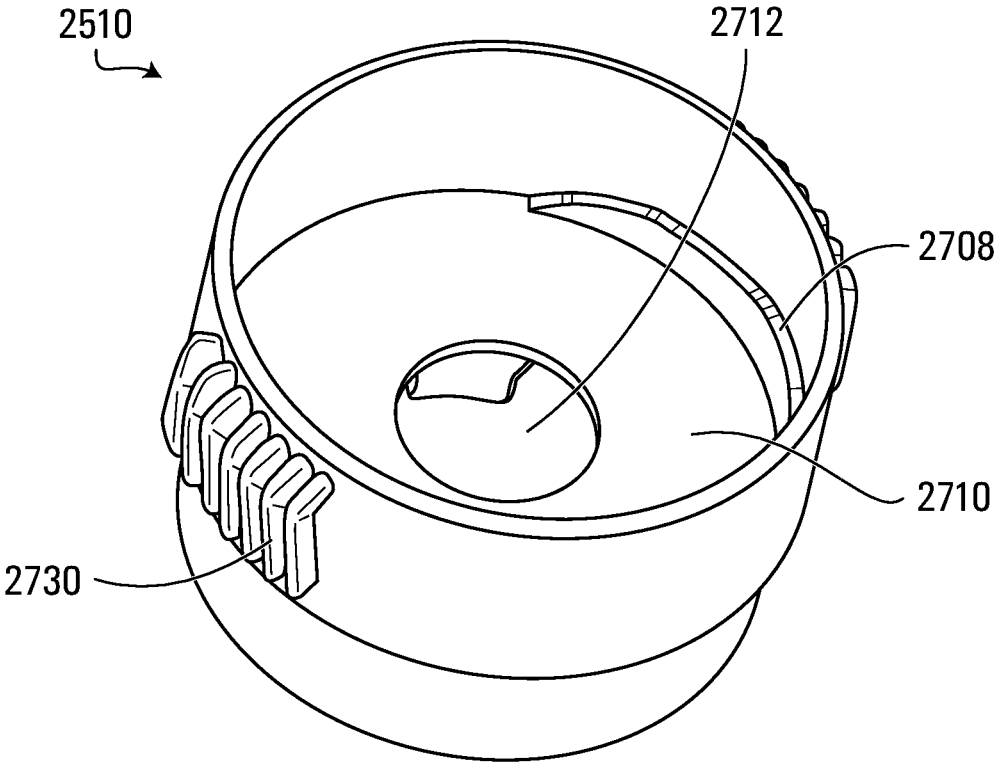

With additional reference to FIGS. 27A and 27B, the dial 2510 includes an upper ring 2702 sitting on top of a lower ring 2704 that has a smaller outside diameter than the upper ring 2702. A circular band 2706 protrudes from the outer surface of the lower ring 2704 and engages a circular recess (not shown) on the inside surface in the shoulder 2502. This combination of the circular band 2706 and the circular recess allows the dial 2510 to be turned relatively to the shoulder 2502.

The dial 2510 is rotated by the user during operation of the dispenser 2310. In the present embodiment, fluid dispensing occurs upon turning the dial 2510 in clockwise, but it will be appreciated that in other embodiments fluid dispensing could occur by turning the dial 2510 in an opposite rotational direction, or in both. The dial 2510 further includes an interior disk 2710. A cylindrical channel 2712 passes longitudinally through a center of the disk 2710. Also, the inner surface of the upper ring 2702 includes a ridge 2708 whose significance will be apparent later on. For its part, the dial 2510 includes a grip 2730 protruding from its outer surface, which can be used to facilitate turning of the dial 2510 but which is also configured so as to abut against a component of the dosage selector 2550, as will be described later on in further detail. It should be appreciated that in some embodiments, the grip 2730 indicates a direction in which the dial 2510 is to be rotated; however, this need not be the case and the grip 2730 may be different configured in different embodiments.

Figure 29:
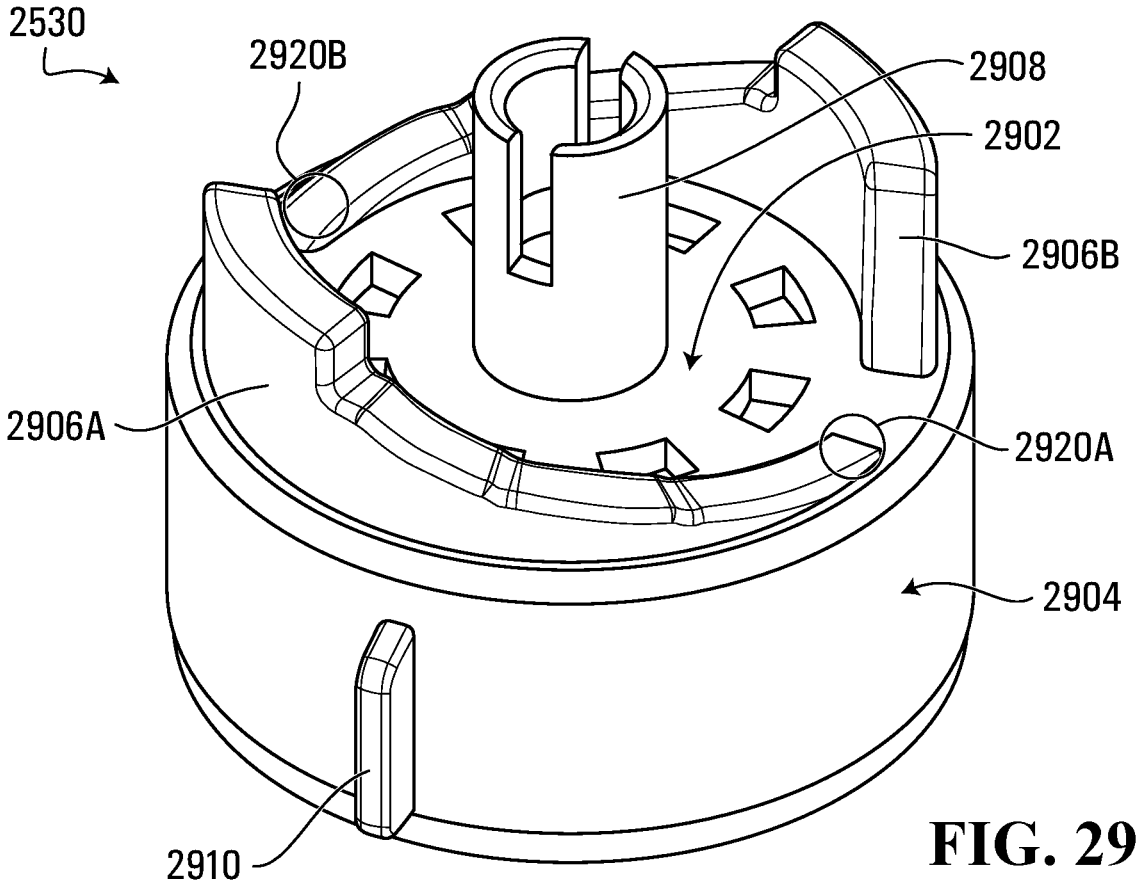
FIG. 29 is a perspective view of a stem forming part of the dispenser of FIG. 25.
Figure 30:
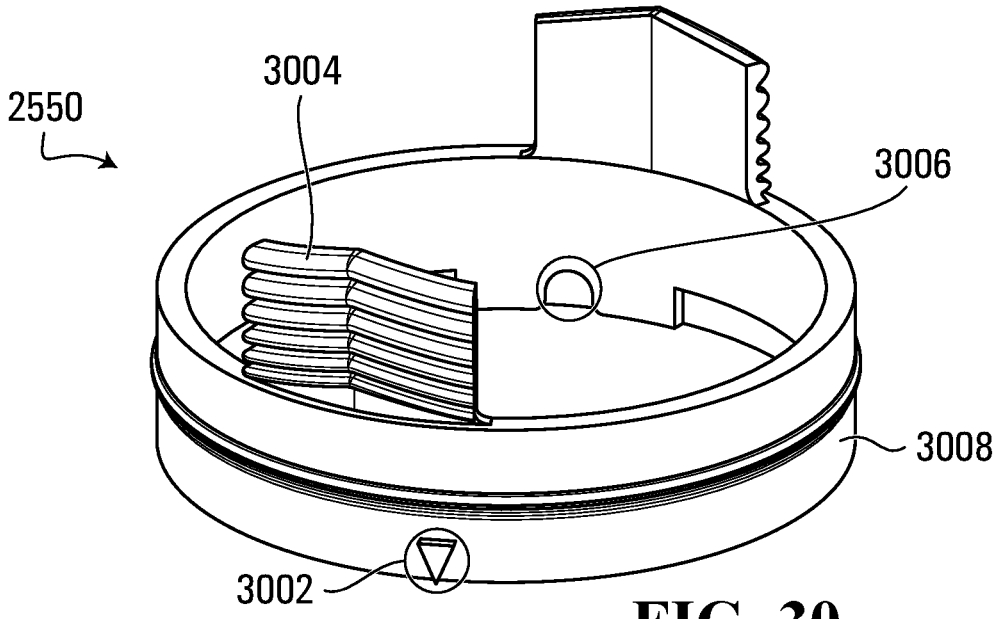
FIG. 30 is a perspective view of a dosage selector forming part of the dispenser of FIG. 25.

Turning now to the stem 2530, and with additional reference to FIG. 29, this cap-shaped component includes a disk 2902 under which hangs a cylindrical outer wall 2904. On top of the disk 2902 are one or more contoured ridges. In this case, there are two contoured ridges 2906A, 2906B that are at 180 degrees apart around a periphery of the disk 2902. In other embodiments, there may be a single contoured ridge, while in still other embodiments, there may be more than two contoured ridges.

A cylindrical wall 2908 of the stem 2530 encompasses the conduit 2820 of the tip 2540, thus creating a passage for fluid towards the egress port 2802 of the tip 2540. In fact, and as best seen in FIG. 24, a protrusion/recess mechanism 2495 on an outer surface of the conduit 2820 and the inner surface of the cylindrical wall 2908 axially locks the conduit to the stem 2530. This means that downward (or upward) displacement of the stem 2530 will cause an accompanying downward (or upward) displacement of the conduit 2820. Also, and as best seen in FIG. 24, the piston rod 2830 includes an expanded end portion 2835, which is retained by a stopper 2840 that is connected to the reservoir 2320. In other words, cycled downward and upward movement of the stem 2530 will provoke corresponding movement of the conduit 2820 while the piston rod 2830 remains "caught" by the stopper 2840, resulting in the piston rod 2830 being pumped. As such, when the undersurface 2418 travels downwards, this pushes both the end portion 2835 and a small spring 2491 downward as well. The compression of the small spring 2491 facilitates the return of the stopper 2840 to its original position in comparison to end portion 2835 (which is shows as having a round opening towards the bottom of the conduit 2830).

The stem 2530 also includes wings 2910 (only one of which is shown in FIG. 29) that slide into the aforementioned axial slots (not shown) in the thin cylindrical wall of the body 2504, which blocks rotational motion of the stem 2530 relative to the body 2504 (and also relative to the housing 2500 as a whole).

By proper configuration of the dial 2510 and of the stem 2530, a transfer of rotational motion of the dial 2510 to axial motion of the stem 2530 can be achieved. Specifically, the stem 2530 and the dial 2510 are in contact with each other through a lower wall 2750 of the dial 2510 and the contoured ridges 2906A, 2906B of the stem 2530, which act as cams. Because when rotated, the dial 2510 is prevented from moving longitudinally, rotation of the dial 2510 will push its lower wall 2750 obliquely against the top surface of the contoured ridges 2906A, 2906B, starting with point 2920A, 2920B (see FIG. 29). Since the stem 2530 itself cannot rotate, the rotational force that it receives from the lower wall 2750 of the dial 2510 is redirected by the oblique shape of the contoured ridges 2906A, 2906B, urging the stem 2530 to undergo a "downwards" axial displacement (away from the dial 2510). This downwards axial displacement of the stem 2530 drags the piston rod 2830 into the chamber 2406, thus actioning the release of fluid. It should be appreciated that this is merely an example and that there is no particular limitation on the type of fluid pumping mechanism that can be used.

Irrespective of the type of valve assembly 2590 that is used, the volume of fluid that is dispensed depends on the amount of axial displacement of the piston rod 2830. This could include the amount of axial displacement on the way down, or on the way up, or both, depending on the design of the valve assembly 2590. The amount of axial displacement of the piston rod 2830 is itself a function of the amount of displacement of the stem 2530, which in turn depends on the extent of angular rotation of the dial 2510.

The dosage selector 2550 in this second version is implemented in the form of a ring 3008 that can be lifted, turned around the central axis and, by pressing down, set to one of a predetermined number of angular positions referred to as "blocking positions". The blocking positions are predetermined by angularly spaced recesses 3006 (only one of which is shown) on an inner surface of the ring 3008 and complementary dimples 2620 in the outer surface of the shoulder 2502 of the housing 2500. The dosage selector 2550 includes a marker 3002 that is placed at an angular position on the ring where it points to one of the dosage amounts displayed on the shoulder 2502.

Each blocking position of the dosage selector 2550 corresponds to a dosage position of the dial 2510. The dosage selector 2550 also includes an upwardly extending blocker 3004. The blocker 3004 may serve two purposes. Firstly, it allows the user to more securely grip the dosage selector 2550 in order for it to be lifted. Secondly, when the dosage selector 2550 is set to a particular blocking position as described above, the blocker 3004 impedes further angular motion of the dial 2510 beyond the dosage position corresponding to the particular blocking position. This is because the grip 2730 of the dial 2510 comes up against the blocker 3004 of the dosage selector 2550 whose angular setting has been fixed. This motion impedance provides a form of perceptible feedback to the user that the corresponding dosage position has been reached by the dial 2510. In this embodiment tactile and/or auditory feedback may be provided.

Figure 31A:
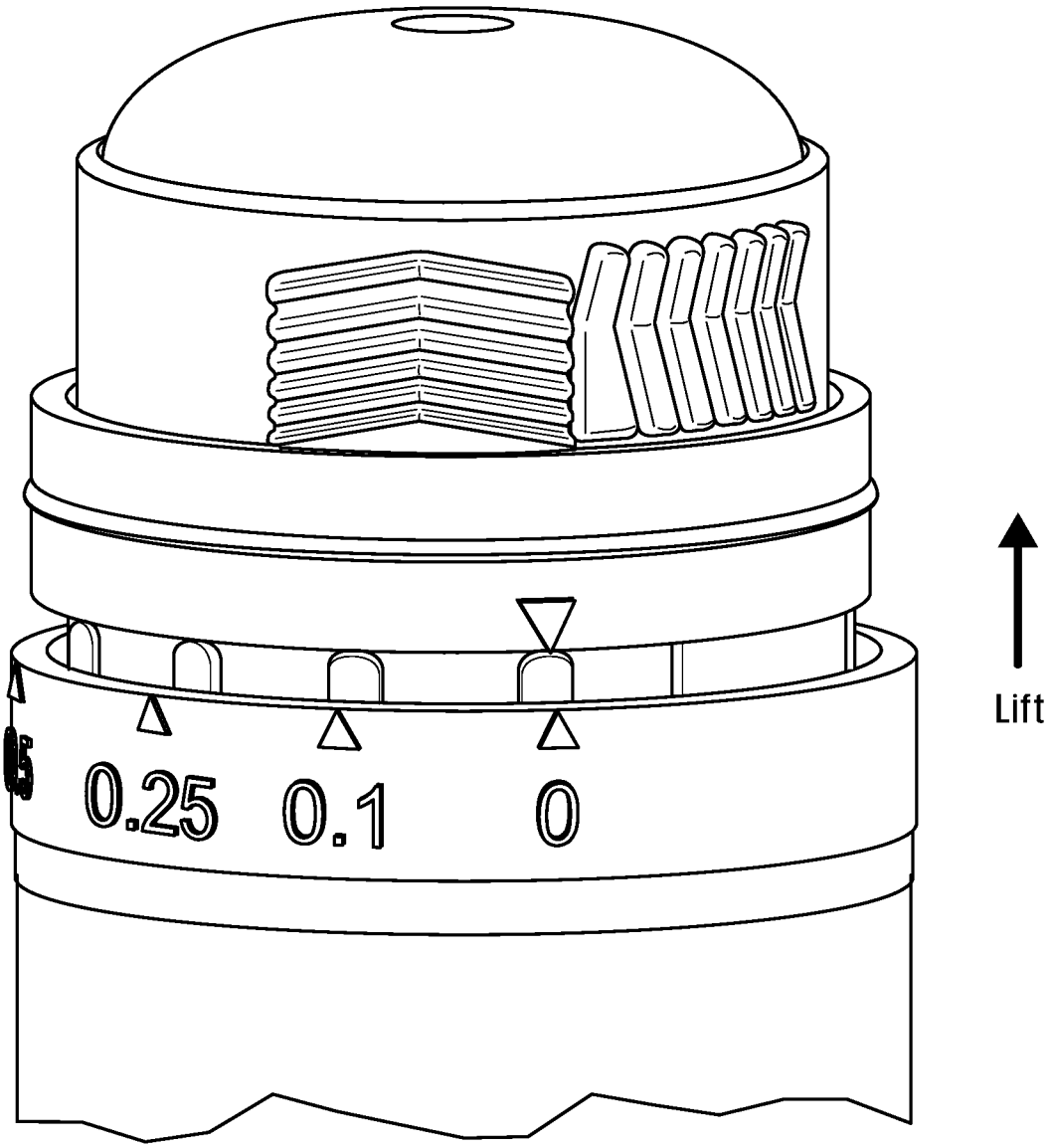
FIGS. 31A to 31E are views of the dispenser during different moments of use and re-setting of the dosage selector, in accordance with a non-limiting embodiment.
Figure 31B:
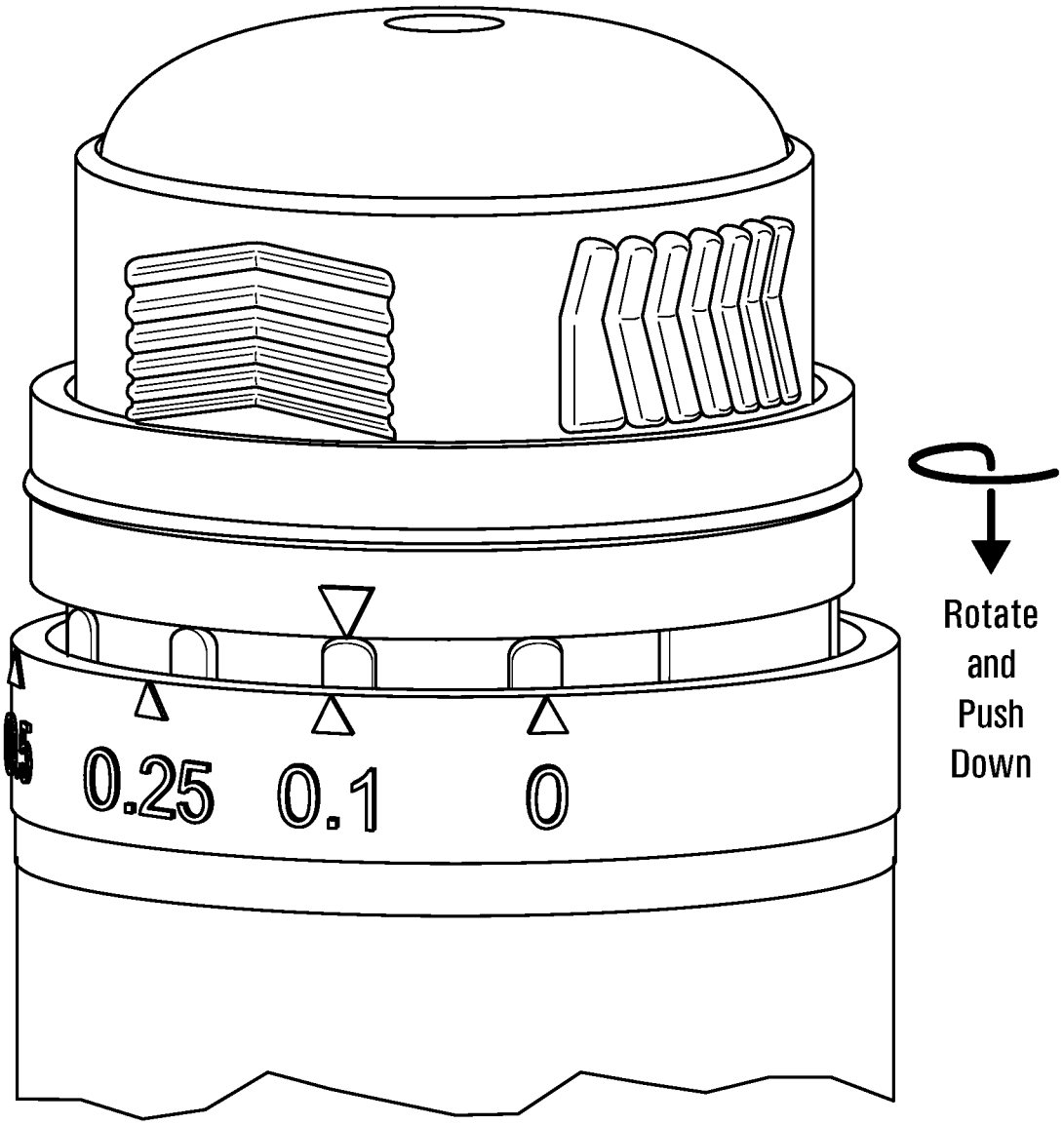
Figure 31C:
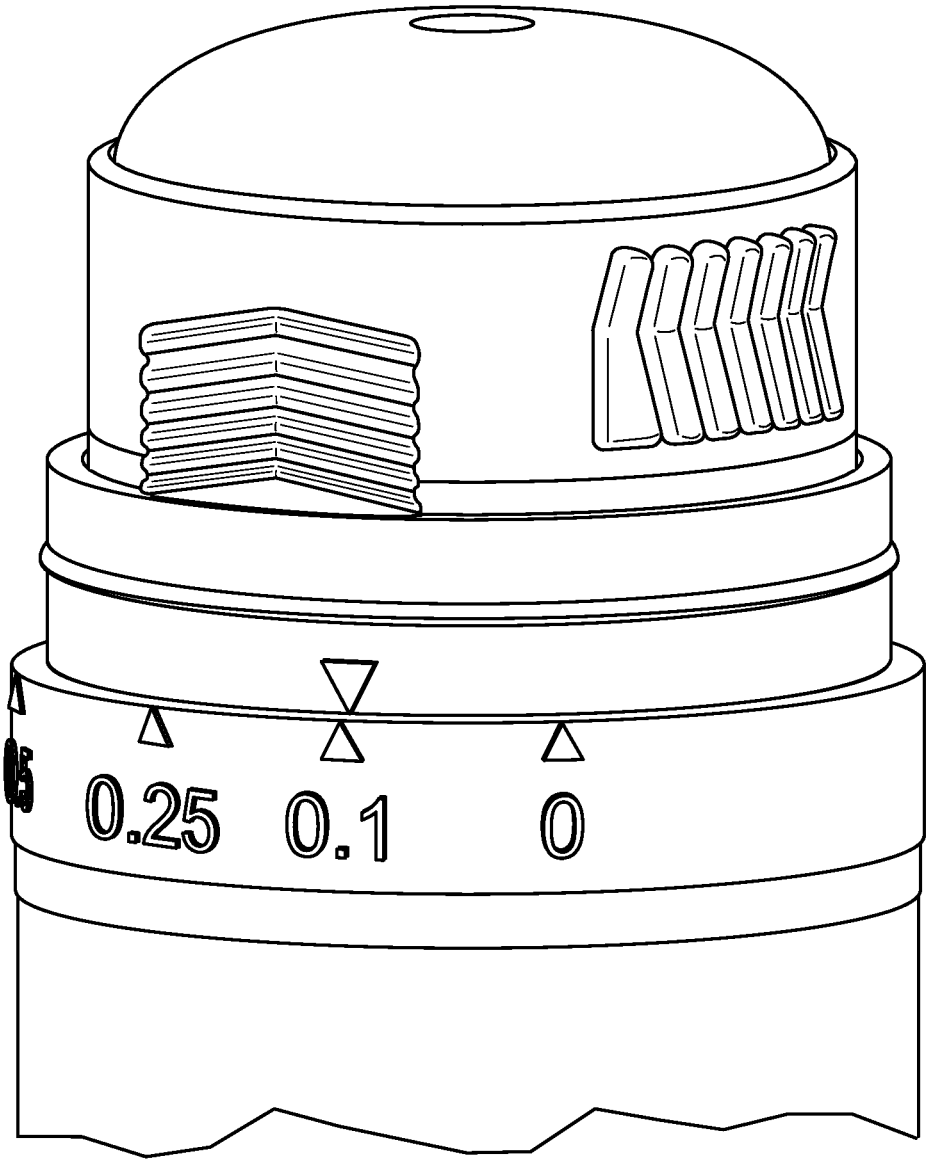
Figure 31D:
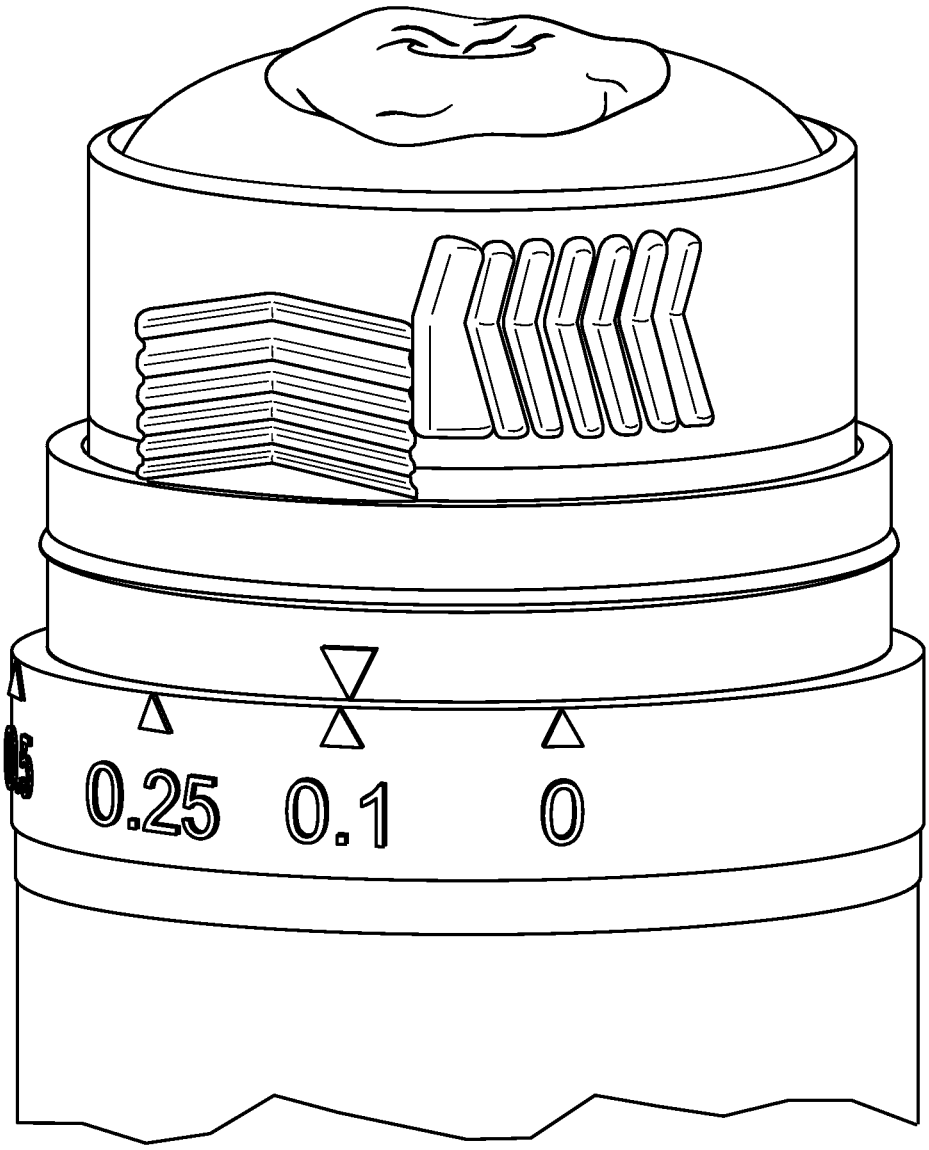
Figure 31E:
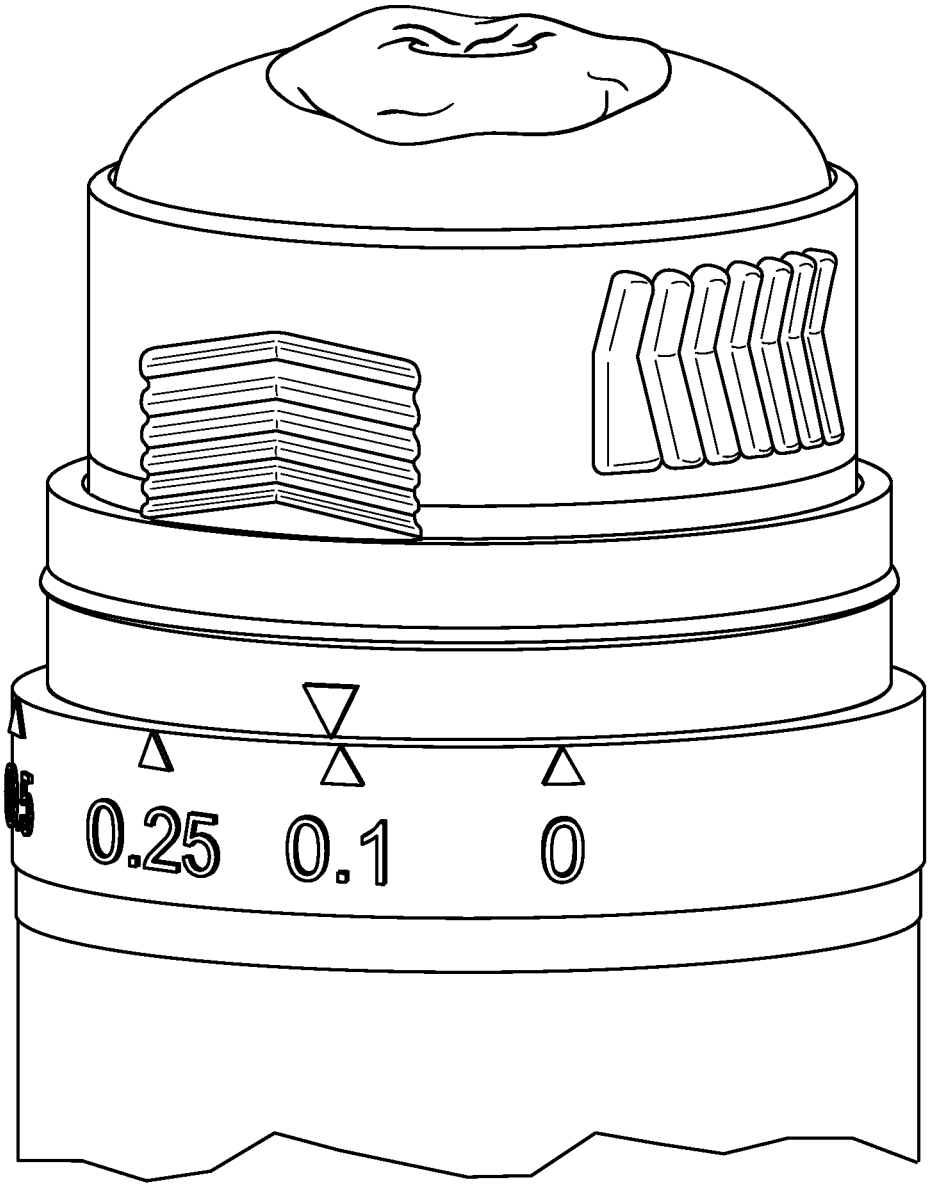

Reference is now made to FIGS. 31A to 31E, which show how to change the setting of the dosage selector 2550. In particular, the user uses the blocker 3004 to push/lift the ring 3008 upwards from its initial position and dislodge the recesses 3006 from the dimples 2620 (FIG. 31A), then the ring 3008 is rotated to the desired angular position (FIG. 31B), and then the ring 3008 pushed downwards so that the dimples 2620 re-enter the recesses 3006 (FIG. 31C), although of course it is a different combination of recesses 3006 that will be entered by the dimples 2620. Once the dosage selector 2550 has been set/locked to a new blocking position, further angular displacement of the dosage selector 2550 is impeded unless the ring is released again. Other manners for setting the dosage selector to a number of blocking positions can be implemented. At this point, the dial 2510 is free to rotate from its initial position to the point where the grip 2730 abuts against the blocker 3004 (FIG. 31D) and back again (FIG. 31E). During this cycle, fluid is dispensed because the piston rod 2830 is pumped due to the stem 2530 being urged downwards as a result of the rotational motion of the dial 2510 being transferred through changes in contour of the contoured ridges 2906A, 2906B.

As the dial 2510 is turned relative to the shoulder 2502, the dial 2510 follows a curved path, defining an angular displacement. Pre-determined angular displacements (referred to as "dosage positions") for the dial 2510 are marked on the shoulder 2502 with respective "dosage indicators" 2650A-C. The dosage indicators align with possible positions for the marker 3002 on the dosage selector 2550 corresponding to possible settings of the dosage selector 2550.

Each given dosage position corresponds to a dosage that the dispenser is configured to dispense during the time period when the dial 2510 is rotated from the start position to the given dosage position (i.e., when the edge of the grip 2730 is aligned with the marker 3002) and back to the start position. Actual dispensing of the fluid may occur during the clockwise half of the dispensing cycle and/or during the counter-clockwise half of the dispensing cycle, depending on the type of valve assembly that is used. In any event, fluid is drawn from the reservoir and released towards an exterior of the container 2300 via the dispenser during at least part of the time when an element (e.g., the dial 2510) of the dispenser 2310 is rotated from the start position to one of a plurality of angularly spaced-apart dosage positions and back to the start position.

The dosage indicators 2650A-C may specify (e.g., by virtue of being printed, debossed or embossed with, or including a sticker indicating) the actual dosage that is dispensed. In a non-limiting embodiment, there are three dosage positions (not including the start position), each corresponding to a different dispensed dosage, although there may be more or fewer possible dosage positions in other practical embodiments.

The range of possible dosages that can be dispensed will naturally depend on the capacity of the chamber 2406. As such, example dosages could be 0.1 ml, 0.2 ml, 0.25 ml, 0.5 ml, 1 ml, 1.5 ml, 2.0 ml and 5.0 ml, to name a few non-limiting possibilities. It should be appreciated that the dosages corresponding to the various dosage positions of the dial 2510 may be independent of one another. Specifically, although it is possible for the second smallest dosage to be an integer multiple of the smallest dosage, this need not be the case. Thus, dosage positions corresponding to dosages of 0.1, ml, 0.25 ml and 0.5 ml may be a feasible and acceptable combination of dosages. Dosage positions that correspond to numerous other dosages and/or combinations of dosages are of course possible, again with no particular restriction as to whether any of the dosages are multiples of one another. It should be appreciated that where dosages X and Y are among the dosages that can be dispensed by the dispenser, and where the suggested or prescribed dosage for, e.g., a medicated cream or lotion, changes over time between dosage X and dosage Y, this can allow the user to easily change from dosage X to dosage Y by simply setting the dosage selector 2550 to a new blocking position corresponding to dosage Y. Rotating the dial 2510 until the grip 2730 is blocked by the blocker 3004 will cause the dial 2510 to reach the dosage position corresponding to dosage Y. The simplicity with which this can be done on the part of the user may facilitate patient compliance with a dosage regime that changes over time.

It should be appreciated that when the dial 2510 is rotated away from the start position towards one of the dosage positions, the spring 2416 is compressed. Conversely, when the dial 2510 is brought back to the start position, this creates headroom for the compressed spring 2416, which expands and applies pressure to the stem 2530 against the dial 2510 towards its original axial position as the dial 2510 returns to the start position.

It is now recalled that the upper ring 2702 of the dial 2510 includes a ridge 2708 on its inner surface. The tip 2540 also comprises an underhanging projection 2804 whose lower surface is very close to or even abuts the highest point of the ridge 2708 when the dispenser 2310 is not in use. This impedes, or even prevents, forced downwards pressure on the tip 2540 by a user in the absence of rotation of the dial 2510. As a result, the chances of accidental or non-mindful dispensing are reduced, as dispensing can only occur if the dial 2510 is rotated.

It has been explained that as the dial 2510 is turned, rotational motion of the dial 2510 is transformed into downwards axial motion of the stem 2530 through contact between the lower wall 2750 of the dial 2510 and the contoured ridges 2906A, 2906B of the stem 2530. In addition, the protrusion/recess mechanism 2495 on the conduit 2820 and the cylindrical wall 2908 forces the downwards motion of the conduit 2820 and, along with it, the underhanging projection 2804. As such, it is necessary for the ridge 2708 to allow clearance for such downward displacement of the underhanging projection 2804 as the stem proceeds on its downward path. Clearly, therefore, one possible shape for the ridge 2708 is a match to the shape of the contoured ridges 2906A, 29068 of the stem 2530. A close match to this shape would provide a constant impedance against uncontrolled dispensing through non-rotation of the dial 2510 (e.g., as would occur if the tip 2540 were pressed down excessively during rotation of the dial 2510 or in the absence of rotation of the dial 2510).

The use of auditory feedback as previously described may also be incorporated as a separate feature, to be used in addition to or instead of the tactile feedback that a dosage position has been reached or is about to be reached.

CONCLUSION

Thus, there has been described an actuator for a fluid dispenser, which comprises a housing attachable to a casing; a dial mounted to the housing; and a component mounted to the housing and attachable to a valve assembly configured to carry fluid from the casing towards an egress port of the actuator. The dial and the component have respective contacting surfaces that are configured to urge the component to undergo axial displacement as the dial is rotated. Also, the housing is configured to impede rotational motion of the component relative to the housing while the component undergoes said axial displacement. Also, the contacting surfaces being are further configured to provide perceptible feedback at a plurality of angular displacements of the dial.

The non-limiting embodiments shown in the Figures only illustrate specific practical examples in which a person of skill may use the concept presented in the present document in order to provide dispensing containers for fluids such as creams and ointments. Other practical implementations may be possible. For example, while the dispenser illustrated in the Figures includes one egress port, a dispenser including a plurality of egress ports can also be contemplated in alternative implementations. For instance, it will be apparent to the person of skill that a dispenser with a plurality of egress ports can be advantageous when dispensing a fluid having an increased viscosity. In another example, it will be apparent to the person of skill that, in specific practical implementations, the dial can serve as direct or indirect topical applicator to a user's skin. It will also be apparent that at least a portion of the surface of the dial can be made of a material which may vary according to an intended application. In another example, it will also be apparent that the dispensing container may be configured so as to include a structural "no touch" application surface, for example a pad, that may allow for hygienic, localized application of the dispensed fluid to a therapeutic area on the user.

Thus, there has also been described a method that includes guiding a user's rotation of a dispenser actuator dial from a start position to a first dosage position, the dial covering a first angular displacement between the start position and the first dosage position, the first dosage position corresponding to the smallest volume of fluid that can be dispensed by the dispenser, and then guiding the user's further rotation of the dial from the first dosage position to an adjacent dosage position, the dial covering a second angular displacement between the first dosage position and the adjacent dosage position, the adjacent dosage position corresponding to the next smallest volume of fluid that can be dispensed by the dispenser, the first and second angular displacements being different, whereby perceptible feedback is provided when each of the first and next dosage positions of the dial has been reached.

It will be understood by those of skill in the art that throughout the present specification, the term "a" or "an" used before a term encompasses embodiments containing one or more to what the term refers. It will also be understood by those of skill in the art that throughout the present specification, the term "comprising", which is synonymous with "including," "containing," or "characterized by," is inclusive or open-ended and does not exclude additional, un-recited elements or method steps.

Certain adaptations and modifications of the described embodiments can be made. Therefore, the above discussed embodiments are to be considered illustrative and not restrictive. Also it should be appreciated that additional elements that may be needed for operation of certain embodiments of the present invention have not been described or illustrated as they are assumed to be within the purview of the person of ordinary skill in the art. Moreover, certain embodiments of the present invention may be free of, may lack and/or may function without any element that is not specifically disclosed herein.

What is claimed is:

1. A dispensing container, comprising:

a casing having a dimension along a longitudinal direction; and a fluid dispenser mounted to the casing and configured so as to cause fluid to be drawn from within the casing and released towards an exterior of the dispensing container via an egress port during at least part of a time when a first element of the fluid dispenser is rotated relative to a second element of the fluid dispenser about an axis from a start position to one of a plurality of angularly spaced-apart dosage positions and back to the start position, wherein the egress port is centered about the axis;

the first element and the second element of the fluid dispenser each having a respective outer annular portion and configured such that an axial distance between the outer annular portions remains constant throughout operation of the fluid dispenser, the outer annular portions being continuously exposed during the operation of the fluid dispenser.

2. The dispensing container fluid dispenser defined in claim 1, further comprising an actuator that includes a stem held within a housing that allows axial displacement of the stem while restricting rotational motion of the stem and that allows rotational motion of a dial while restricting axial displacement of the dial, wherein the stem and the dial have respective contacting surfaces that are profiled so as to urge the stem axially upon rotation of the dial.

3. The dispensing container defined in claim 2, wherein the respective contacting surfaces are profiled to include a plurality of segments associated with corresponding ones of the dosage positions.

4. The dispensing container defined in claim 3, wherein the actuator is configured to provide perceptible feedback at each of the plurality of dosage positions, and the perceptible feedback comprises audible feedback provided to a user of the dial.

5. The dispensing container defined in claim 4, wherein the perceptible feedback comprises tactile feedback provided to the user of the dial.

6. The dispensing container defined in claim 4, wherein the perceptible feedback comprises a resistance to rotation of the dial that peaks when the dial reaches one of the dosage positions.

7. The dispensing container defined in claim 4, wherein the respective contacting surfaces provide increasing axial displacement of the stem with increasing rotation of the dial.

8. The dispensing container defined in claim 4, wherein the actuator includes a rotatable dosage selector, the dosage selector being configured to be lockable to the housing at a selected one of a plurality of predetermined angular positions corresponding to the dosage positions.

9. The dispensing container defined in claim 8, wherein the dosage selector when locked to a particular predetermined angular position corresponding to a particular dosage position is configured to block rotation of the dial past the angular position corresponding to the particular dosage position.

10. The dispensing container defined in claim 9, wherein the perceptible feedback is provided by rotation of the dial past the angular position corresponding to the particular dosage position being blocked.

11. The dispensing container defined in claim 8, wherein the dosage selector is configured to be releasable by the user and lockable at a different predetermined angular position.

12. The dispensing container defined in claim 2, further comprising a valve assembly that is configured to expel the fluid from inside the fluid dispenser out through the egress port of the fluid dispenser upon rotation of the dial.

13. The dispensing container defined in claim 12, the actuator further comprising a tip comprising the egress port, wherein the tip is axially locked to the stem and wherein the actuator is configured to block axial movement of the tip in an absence of rotation of the dial.

14. The dispensing container defined in claim 12, wherein the valve assembly is configured to expel a first amount of the fluid from inside the fluid dispenser out through the egress port of the fluid dispenser upon rotation of the dial from the start position towards a first one of the dosage positions and to expel a second, different, amount of the fluid from inside the fluid dispenser out through the egress port of the fluid dispenser upon rotation of the dial from the start position towards a second one of the dosage positions.

15. The dispensing container defined in claim 12, wherein the valve assembly comprises a piston that reciprocates axially to draw the fluid from a reservoir and push the fluid out through the egress port of the fluid dispenser.

16. The dispensing container defined in claim 15, wherein the actuator comprises the stem, wherein the piston is moved in one axial direction by the stem that exhibits displacement in said one axial direction in response to rotation of the dial in one rotational direction.

17. The dispensing container defined in claim 2, wherein the actuator comprises the egress port through which the fluid is released from the fluid dispenser.

18. The dispensing container defined in claim 1, wherein the dosage positions are predetermined and built into the fluid dispenser.

19. The dispensing container defined in claim 1, wherein the plurality of dosage positions includes at least two dosage positions.

20. The dispensing container defined in claim 1, wherein the plurality of dosage positions includes at least three dosage positions corresponding to respective dosages, one of which is a smallest dosage and the others being larger dosages, at least one of the larger dosages being a multiple of the smallest dosage.

21. The dispensing container defined in claim 1, wherein the plurality of dosage positions includes at least three dosage positions corresponding to respective dosages, one of which is a smallest dosage and the others being larger dosages, at least one of the larger dosages not being a multiple of the smallest dosage.

22. The dispensing container defined in claim 1, further comprising a component and a housing, wherein the component or the housing comprises at least one projection disposed about a periphery thereof and wherein the other of the component and the housing comprises at least one elongated axially oriented recess disposed about a periphery thereof, wherein the component is mounted to the housing so that the at least one projection enters the at least one elongated axially oriented recess, thereby locking the component from rotational motion relative to the housing while allowing axial motion of the component relative to the housing.

23. The dispensing container defined in claim 22, wherein the housing is configured to block axial displacement of a dial relative to the housing.

24. The dispensing container defined in claim 23, wherein the dial comprises an exterior surface that is textured around at least a portion of a periphery thereof thereby to facilitate gripping of the dial by a user.

25. The dispensing container defined in claim 23, wherein a plurality of contacting surfaces of the dial and the component are profiled so as to block rotational motion of the dial after the dial has covered one of a plurality of angular displacements that is furthest from the start position, and wherein the contacting surfaces are further configured to provide perceptible feedback at the plurality of angular displacements of the dial.

26. The dispensing container defined in claim 25, wherein the perceptible feedback is indicative of a selected dosage position having been reached.

27. The dispensing container defined in claim 25, wherein the plurality of angular displacements include a first angular displacement and a second angular displacement, the first angular displacement being a smallest one of the angular displacements, the second angular displacement being a next smallest one of the angular displacements, wherein the second angular displacement is not twice the first angular displacement.

28. The dispensing container defined in claim 23, further comprising a dosage selector rotatably mounted to the housing and settable to a plurality of predetermined angular blocking positions.

29. The dispensing container defined in claim 28, wherein the dosage selector comprises a blocker to impede angular movement of the dial past an angular position that is a function of a blocking position to which the dosage selector has been set.

30. The dispensing container defined in claim 28, wherein one of the dosage selector and the housing includes a plurality of projections, and wherein the other of the dosage selector and the housing includes a plurality of recesses, and wherein to set the dosage selector to a particular one of the angular blocking positions, at least some of the projections are entered into at least some of the recesses.

31. The dispensing container defined in claim 23, further comprising a tip with the egress port through which the fluid is dispensed, the tip and the dial being configured to impede axial movement of the tip unless the dial is rotated.

32. The dispensing container defined in claim 1, wherein the fluid dispenser is mountable either to a first casing having a reservoir configured to hold a first volume of fluid, or to a second casing having a reservoir configured to hold a second volume of fluid, said first volume of fluid and second volume of fluid being different one from the other.

33. The dispensing container defined in claim 1, wherein the casing includes a see-through region allowing a level of the fluid to be visible from outside the dispensing container.

34. A method, comprising:

setting a dosage selector of a dispensing container to a first dosage position;

rotating, in a first operation of the dispensing container, a first element of the dispensing container relative to a second element of the dispensing container about an axis from a start position until blocked by the dosage selector in the first dosage position and back to the start position, thereby to cause a first amount of fluid to be dispensed by the dispensing container, the first element and the second element of the dispensing container each having a respective outer annular portion and configured such that an axial distance between the outer annular portions remains constant throughout the first operation of the dispensing container, the outer annular portions being continuously exposed during the first operation of the dispensing container;

releasing the dosage selector from the first dosage position, and setting the dosage selector to a second dosage position; and rotating, in a second operation of the dispensing container, the first element from the start position until blocked by the dosage selector in the second dosage position and back to the start position, thereby to cause a second amount of the fluid to be dispensed by the dispensing container, the second amount of the fluid being different than the first amount of the fluid, and the axial distance between the outer annular portions remains constant throughout the second operation of the dispensing container, the outer annular portions being continuously exposed during the second operation of the dispensing container.

35. The method defined in claim 34, wherein the first amount of the fluid corresponds to a smallest dosage and wherein the second amount of the fluid corresponds to a different dosage, and wherein the different dosage is not a multiple of the smallest dosage.

* * * * *